US007835680B2

(12) United States Patent
Nanjo et al.

(10) Patent No.: US 7,835,680 B2
(45) Date of Patent: Nov. 16, 2010

(54) IMAGE FORMING APPARATUS WITH INDUCTION HEATING COIL UNIT AND A MAGNETISM ADJUSTING MEMBER WITH A CLOSED FRAME SHAPE

(75) Inventors: Yuzuru Nanjo, Osaka (JP); Eiji Nakajima, Osaka (JP); Akihiro Kondo, Osaka (JP); Naoyuki Ishida, Osaka (JP); Syoukou Gon, Osaka (JP); Kenichi Kasama, Osaka (JP)

(73) Assignee: Kyocera Mita Corporation (JP)

( * ) Notice: Subject to any disclaimer, the term of this patent is extended or adjusted under 35 U.S.C. 154(b) by 43 days.

(21) Appl. No.: 12/344,940

(22) Filed: Dec. 29, 2008

(65) Prior Publication Data

US 2009/0175664 A1 Jul. 9, 2009

(30) Foreign Application Priority Data

Jan. 7, 2008 (JP) ..... 2008-000433
Jan. 7, 2008 (JP) ..... 2008-000686

(51) Int. Cl.
*G03G 15/20* (2006.01)

(52) U.S. Cl. ..... 399/329; 399/330; 399/334; 219/619

(58) Field of Classification Search ..... 219/619; 399/67, 328–330
See application file for complete search history.

(56) References Cited

U.S. PATENT DOCUMENTS 7,266,336 B2 * 9/2007 Ueno et al. ..... 399/329

FOREIGN PATENT DOCUMENTS

| | | |
|---|---|---|
| JP | 6-318001 | 11/1994 |
| JP | 2003-107941 | 4/2003 |
| JP | 3527442 | 5/2004 |

* cited by examiner

*Primary Examiner*—Hoang Ngo
(74) *Attorney, Agent, or Firm*—Gerald E. Hespos; Michael J. Porco

(57) ABSTRACT

A fixing unit (14) of an image forming apparatus (1) includes a heating member (48) having a first area where a sheet does not come into contact with the heating member (48) and a second area where the sheet comes into contact with the heating member (48). The fixing unit (14) further includes a coil (52) forming a magnetic field, cores (54,56) forming a magnetic path near the coil (52), a nonmagnetic magnetism adjusting member (90) arranged on the magnetic path and having a closed frame, and a switcher (58,60) capable of switching the magnetism adjusting member (90) between a first state where the magnetism adjusting member (90) generates an induction current resulting from the magnetic field to shield the magnetism in the first area, and a second state where the magnetism adjusting member (90) generates no induction current and the magnetism is not shielded in the first area.

20 Claims, 23 Drawing Sheets

IMAGE FORMING APPARATUS WITH INDUCTION HEATING COIL UNIT AND A MAGNETISM ADJUSTING MEMBER WITH A CLOSED FRAME SHAPE

BACKGROUND OF THE INVENTION

1. Field of the Invention

The present invention relates to an image forming apparatus provided with a fixing unit for heating and melting unfixed toner and fixing it to a sheet bearing a toner image while permitting the sheet to pass a nip between a pair of rollers heated or between a heating belt and a roller.

2. Description of the Related Art

In recent years, attention has been focused on belt-type image forming apparatuses, in which a smaller heat capacity can be set, due to demands of shortening a warm-up time and saving energy in a fixing unit (see, for example, Japanese Unexamined Patent Publication No. H06-318001). Attention has been also focused on an electromagnetic induction heating method (IH) with a possibility of quick heating and high efficiency heating in recent years, and many products as a combination of electromagnetic induction heating and the employment of a belt have commercialized in light of saving energy upon fixing a color image. In the case of combining the employment of a belt and electromagnetic induction heating, an electromagnetic induction device is often arranged at an outer side of the belt due to merits that a coil can be easily laid out and cooled and further the belt can be directly heated (so-called external IH).

In the above electromagnetic induction heating method, various technologies have been developed to prevent an excessive temperature increase in a sheet non-passage area in consideration of a sheet width (paper width) passed through the fixing unit. Particularly, the following prior arts are known as size switching means in the external IH (for example, Japanese Unexamined Patent Publication No. 2003-107941, Publication of Japanese Patent No. 3527442).

A first prior art (Japanese Unexamined Patent Publication No. 2003-107941 (FIGS. 2 and 3)) discloses that a magnetic member is divided into a plurality of pieces, which are arranged in a sheet width direction, and some of the magnetic member pieces are moved toward or away from an exciting coil in accordance with the size of a sheet to be passed (paper width). In this case, heating efficiency decreases by moving the magnetic member pieces away from the exciting coil in sheet non-passage areas, and the amount of heat generation is thought to be less than in an area corresponding to a sheet with a minimum paper width.

A second prior art (Publication of Japanese Patent No. 3527442 (FIG. 10)) discloses that other conductive members are arranged outside a minimum paper width in a heating roller and the positions thereof are switched between those inside and outside the extent of a magnetic field. According to this prior art, the conductive members are first located outside the extent of the magnetic field to heat the heating roller by electromagnetic induction. If the temperature of the heating roller rises to the vicinity of a Curie temperature, the conductive members are moved to the extent of the magnetic field, thereby causing magnetic fluxes to leak from the heating roller outside the minimum paper width for the prevention of excessive temperature increases.

In the above first and second prior arts, an excessive temperature increase suppressing effect better than before is necessary to improve productivity more than at present. In other words, even if magnetism is shielded outside the paper passage area in the case of passing a small-size sheet, the temperatures of the heating roller and the like increase by the leaking magnetic field and eventually reach excessive temperature increases if the magnetic field (magnetic fluxes) leaks little by little from there. As means for preventing this, a method for making, for example, the area of a magnetic shielding plate larger than at present can be thought.

However, if the area of the shielding plate is excessively enlarged, the magnetic field is influenced even if the shielding plate is retracted. For example, even if the shielding plate is retracted when induction heating is necessary over the entire width of the heating roller, induction heating becomes insufficient, which is not suitable, if the magnetic field is shielded by the influence of the shielding plate at the retracted position. Therefore, there is a natural limit in enlarging the area of the shielding plate even if the excessive temperature increase suppressing effect is improved more than at present.

SUMMARY OF THE INVENTION

An object of the present invention is to provide an image forming apparatus having a fixing unit capable of obtaining an excessive temperature increase suppressing effect in end areas of a heating roller and the like without excessively enlarging the areas of a shielding plate and the like and also capable of making it least likely to be influenced by the shielding plate and the like with the shielding plate and the like retracted.

In order to accomplish this object, the present invention is directed to an image forming apparatus which includes an image forming unit for transferring a toner image to a sheet, and a fixing unit having a heating member and a pressing member and adapted to convey the sheet while holding the sheet between the heating member and the pressing member and to fix the toner image to the sheet by heat at least from the heating member in a conveying process. The heating member has a first area where a sheet does not come into contact with the heating member when the sheet being conveyed by the fixing unit passes the heating member, and a second area where the sheet comes into contact with the heating member when the sheet being conveyed by the fixing unit passes the heating member. The first area and the second area are set according to the size of the sheet. The fixing unit further includes a coil for forming a magnetic field by generating magnetism for induction heating the heating member, a core made of a magnetic material to form a magnetic path near the coil, a magnetism adjusting member made of a nonmagnetic material, arranged on the magnetic path and having a closed frame, and a switcher capable of switching the magnetism adjusting member between a first state where the magnetism adjusting member generates an induction current resulting from the magnetic field to shield the magnetism in the first area, and a second state where the magnetism adjusting member generates no induction current and the magnetism is not shielded in the first area.

DETAILED DESCRIPTION OF THE PREFERRED EMBODIMENTS

Hereinafter, embodiments of the present invention are described in detail with reference to the accompanying drawings.

Figure 1:
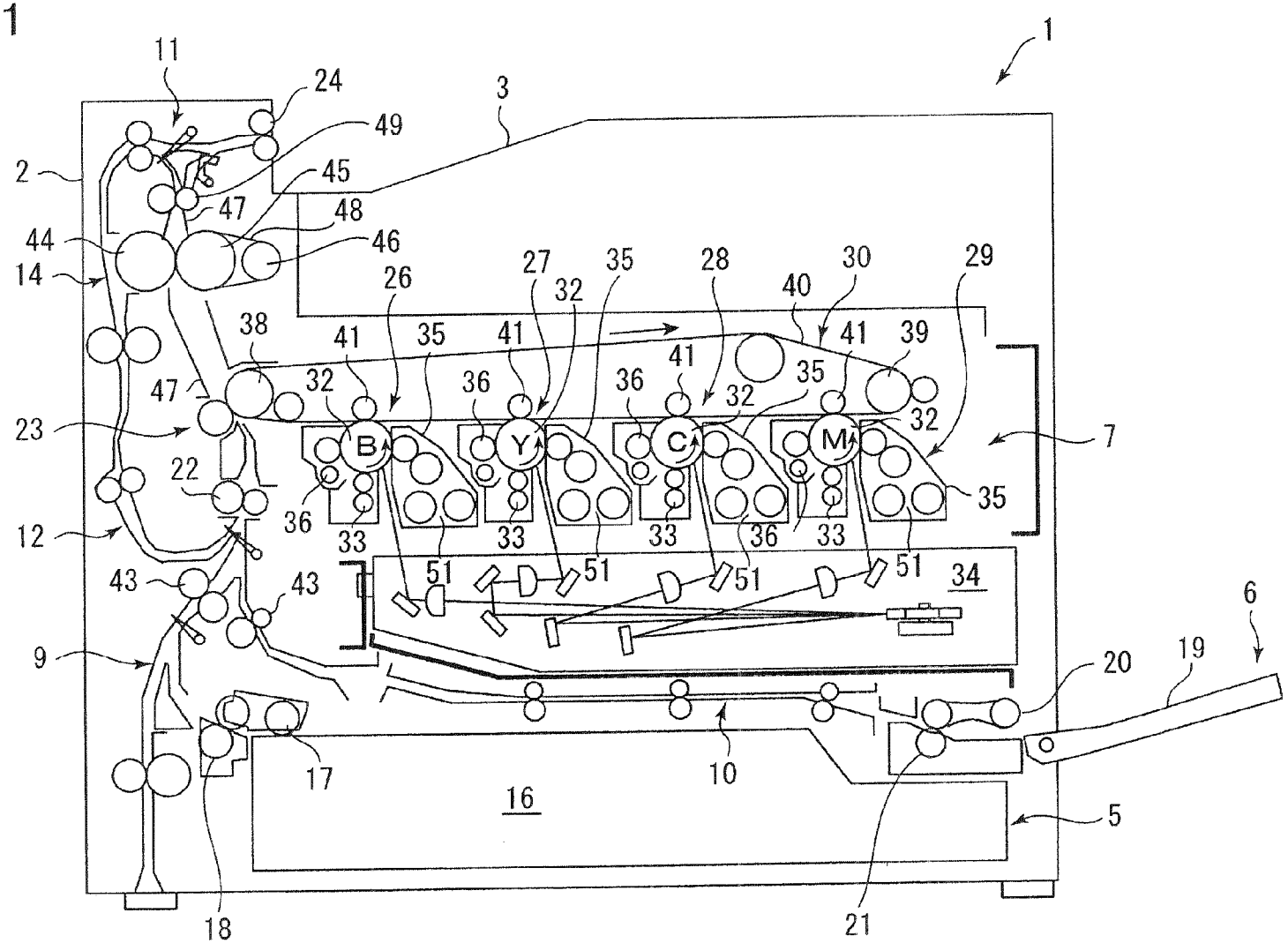
FIG. 1 is a schematic diagram showing the construction of an image forming apparatus according to one embodiment of the invention.

FIG. 1 is a schematic diagram showing the construction of an image forming apparatus 1 according to one embodiment of the present invention. The image forming apparatus 1 can be a printer, a copier, a facsimile machine, a complex machine provided with these functions or the like for printing by transferring a toner image to the surface of a print medium such as a print sheet, for example, in accordance with externally inputted image information.

The image forming apparatus 1 shown in FIG. 1 is a tandem color printer. This image forming apparatus 1 includes an apparatus main body 2 in the form of a rectangular box for forming (printing) inside a color image on a sheet. A sheet discharge unit (discharge tray) 3 for discharging a sheet having a color image printed thereon is provided in a top part of the apparatus main body 2.

A sheet cassette 5 for storing sheets is arranged at the bottom in the interior of the apparatus main body 2, a stack tray 6 for manually feeding a sheet is arranged in an intermediate part, and an image forming station 7 is arranged in an upper part. The image forming station 7 forms (transfers) a toner image on a sheet based on image data such as characters and pictures transmitted from the outside of the apparatus.

A first conveyance path 9 for conveying a sheet dispensed from the sheet cassette 5 to the image forming station 7 is arranged in a left part of the apparatus main body 2 in FIG. 1, and a second conveyance path 10 for conveying a sheet dispensed from the stack tray 6 to the image forming station 7 is arranged from a right side to the left side in the apparatus main body 2. Further, a fixing unit 14 for performing a fixing process to a sheet having an image formed thereon in the image forming station 7 and a third conveyance path 11 for conveying the sheet finished with the fixing process to the sheet discharging unit 3 are arranged in a left upper part in the apparatus main body 2.

The sheet cassette 5 enables the replenishment of sheets by being withdrawn toward the outside (e.g. toward front side in FIG. 1) of the apparatus main body 2. This sheet cassette 5 includes a storing portion 16, which can selectively store at least two types of sheets having different sizes in a feeding direction. Sheets stored in the storing portion 16 are picked up one by one by a feed roller 17 and separation rollers 18 and transported toward the first conveyance path 9.

The stack tray 6 can be opened and closed relative to an outer surface of the apparatus main body 2, and sheets to be manually fed are placed one by one or a plurality of sheets are placed on a manual feeding portion 19. Sheets placed on the manual feeding portion 19 are picked up one by one by a pickup roller 20 and separation rollers 21 and transported toward the second conveyance path 10.

The first conveyance path 9 and the second conveyance path 10 join before registration rollers 22. A sheet fed to the registration rollers 22 temporarily waits on standby here and is conveyed toward a secondary transfer unit 23 after a skew adjustment and a timing adjustment. A full color toner image on an intermediate transfer belt 40 is secondarily transferred to the conveyed sheet in the secondary transfer unit 23. Thereafter, the sheet having the toner image fixed in the fixing unit 14 is reversed in a fourth conveyance path 12 if necessary, so that a full color toner image is secondarily transferred also to the opposite side of the sheet in the secondary transfer unit 23. After the toner image on the opposite side is fixed in the fixing unit 14, the sheet is discharged to the sheet discharging unit 3 by discharge rollers 24 through the third conveyance path 11.

The image forming station 7 includes four image forming units 26, 27, 28 and 29 for forming toner images of black (B), yellow (Y), cyan (C) and magenta (M) and an intermediate transfer unit 30 for bearing the toner images of the respective colors formed in the image forming units 26 to 29 in a superimposed manner.

Each of the image forming units 26 to 29 includes a photosensitive drum 32, a charger 33 arranged to face the circumferential surface of the photosensitive drum 32, a laser scanning unit 34 arranged downstream of the charger 33 for emitting a laser beam to a specific position on the circumferential surface of the photosensitive drum 32, a developing device 35 arranged to face the circumferential surface of the photosensitive drum 32 downstream of the laser beam emission position from the laser scanning unit 34 and a cleaning device 36 arranged downstream of the developing device 35 to face the photosensitive drum 32.

The photosensitive drum 32 of each of the image forming units 26 to 29 is rotated in a counterclockwise direction in FIG. 1 by an unillustrated drive motor. Black toner, yellow toner, cyan toner and magenta toner are respectively contained in toner boxes 51 of the developing devices 35 of the respective image forming units 26 to 29.

The intermediate transfer unit 30 includes a drive roller 38 arranged at a position near the image forming unit 26, a driven roller 39 arranged at a position near the image forming unit 29, the intermediate transfer belt 40 tensioned between the drive roller 38 and the driven roller 39, and four transfer rollers 41 arranged in opposed relation with the photosensitive drums 32 of the respective image forming units 26 to 29. The respective transfer rollers 41 are arranged at positions downstream of the developing devices 35 of the corresponding image forming units 26 to 29 such that they can be pressed into contact with the photosensitive drum 32 via the intermediate transfer belt 40.

In this intermediate transfer unit 30, the toner images of the respective colors are transferred in a superimposition manner on the intermediate transfer belt 40 at the positions of the transfer rollers 41 of the respective image forming units 26 to 29. As a result, a full color toner image is finally formed on the intermediate transfer belt 40.

The first conveyance path 9 conveys a sheet dispensed from the sheet cassette 5 toward the intermediate transfer unit 30. The first conveyance path 9 includes a plurality of conveyor rollers 43 arranged at specified positions in the apparatus main body 2 and the registration rollers 22 arranged before the intermediate transfer unit 30 for timing an image forming operation and a sheet feeding operation in the image forming station 7.

The fixing unit 14 fixes an unfixed toner image to a sheet by heating and pressing the sheet having the toner image transferred thereto in the image forming station 7. The fixing unit 14 includes a pair of heating rollers comprised of a pressure roller 44 (pressing member) and a fixing roller 45. The pressure roller 44 is a metallic roller, and the fixing roller 45 is comprised of a metallic core material, an outer layer (e.g. silicon sponge) made of elastic material and a mold releasing layer (e.g. PFA). Further, a heat roller 46 is disposed adjacent to the fixing roller 45, and a heating belt 48 (heating member) is mounted on this heat roller 46 and the fixing roller 45. Alternatively, a heating belt as a heating member may be wound around the outer circumferential surface of the fixing roller 45. A detailed structure of the fixing unit 14 is described later.

Conveyance paths 47 are arranged upstream and downstream of the fixing unit 14 in a sheet conveying direction. A sheet conveyed through the intermediate transfer unit 30 is introduced to a nip between the pressure roller 44 and the fixing roller 45 (heating belt 48) via the upstream conveyance path 47. The sheet having passed the nip between the pressure roller 44 and the fixing roller 45 is guided to the third conveyance path 11 via the downstream conveyance path 47.

The third conveyance path 11 conveys the sheet finished with the fixing process in the fixing unit 14 to the sheet discharging unit 3. Conveyer rollers 49 are arranged at a suitable position in the third conveyance path 11 and the above discharge rollers 24 are arranged at the exit of the third conveyance path 11.

[Details of the Fixing Unit]

Next, first to third embodiments of the fixing unit 14 applied to the image forming apparatus 1 are successively described.

First Embodiment

Figure 2:
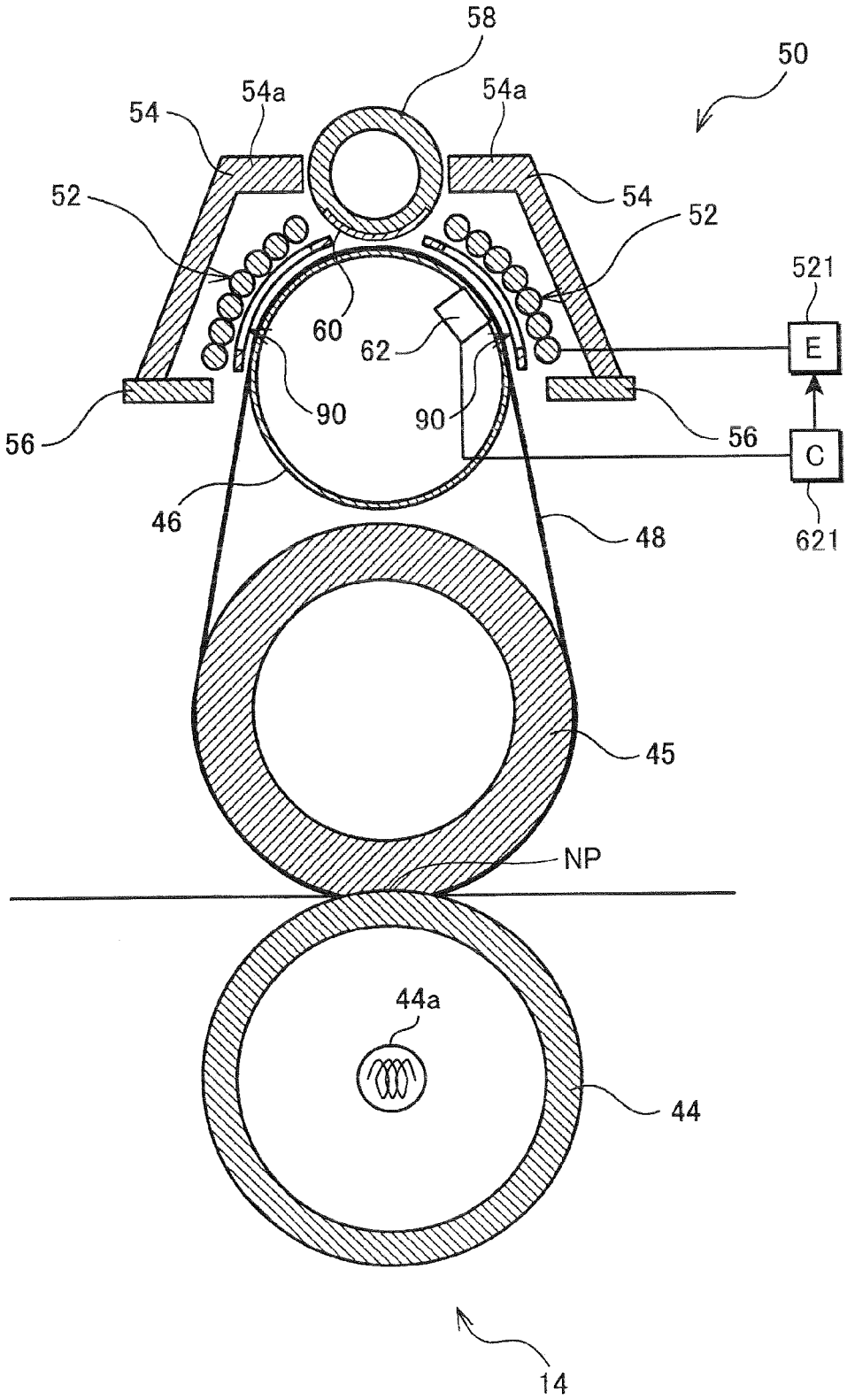
FIG. 2 is a vertical section showing a fixing unit according to a first embodiment of the invention.

FIG. 2 is a vertical section showing the fixing unit 14 of the first embodiment. In a state shown in FIG. 2, the orientation of the fixing unit 14 is rotated counterclockwise by about 90° from an actually mounted state in the image forming apparatus 1. Accordingly, the sheet conveying direction from lower side to upper side in FIG. 1 is from right side to left side in FIG. 2. If the apparatus main body 2 has a larger size (complex machine or the like), the fixing unit 14 may be actually mounted in the orientation shown in FIG. 2.

The fixing unit 14 includes the pressure roller 44, the fixing roller 45, the heat roller 46 and the heating belt 48 as described above. As described above, the pressure roller 44 is made of a metal, but the fixing roller 45 includes the elastic layer of silicon sponge on the outer layer. Thus, a flat nip NP is formed between the heating belt 48 and the fixing roller 45. It should be noted that a halogen heater 44*a* is disposed in the pressure roller 44. A base member of the heating belt 48 is made of a ferromagnetic material (e.g. Ni), a thin elastic layer (e.g. silicon rubber) is formed on the outer surface of the base member, and the mold releasing layer (e.g. PFA) is formed on the outer surface of the elastic layer. A core of the heat roller 46 is made of a magnetic metal (e.g. Fe) and a mold releasing layer (e.g. PFA) is formed on the outer surface of the core.

The fixing unit 14 conveys the sheet while holding it in the nip NP between the pressure roller 44 and the fixing roller 45 via the heating belt 48. In this conveyance process, the sheet receives heat from the pressure roller 44 and the heating belt 48, whereby the toner image transferred onto the sheet is fixed to the sheet.

The fixing unit 14 further includes an IH coil unit 50 (not shown in FIG. 1) at an outer side of the heat roller 46 and the heating belt 48. The IH coil unit 50 includes an induction heating coil 52, a pair of arch cores 54, a pair of side cores 56 and a center core 58.

[Coil]

As shown in FIG. 2, since the induction heating coil 52 performs induction heating to an arcuate surface on the outer circumference of the heat roller 46 and also to an arcuate surface of the heating belt 48 wound around the heat roller 46, the induction heating coil 52 is arranged on an imaginary arcuate surface extending along such arcuate surfaces of the heat roller 46 and the heating belt 48. Further, the induction heating coil 52 extends in a longitudinal direction of the heat roller 46 and substantially entirely covers the heat roller 46 in the longitudinal direction. Actually, an unillustrated resin cover is arranged at the outer side of the heat roller 46 and the heating belt 48 and the induction heating coil 52 is wound around this resin cover.

[Core]

As shown in FIG. 2, the arch cores 54 and the side cores 56 are arranged in pairs at the opposite sides of the center core 58, and the center core 58 is located between the pair of the arch cores 54. The arch cores 54 at the opposite sides of the center core 58 are cores made of ferrite and formed to have arched cross sections symmetrical with each other, and the entire lengths thereof are longer than a winding area of the induction heating coil 52. The side cores 56 at the opposite sides of the center core 58 are cores made of ferrite and having a block shape. The side cores 56 are coupled to one ends (lower ends in FIG. 2) of the corresponding arch cores 54 and cover the outer side of the winding area of the induction heating coil 52. The arch cores 54 and the side cores 56 are, for example, fixedly arranged at a plurality of positions spaced apart in the longitudinal direction of the heat roller 46. The arrangement of the cores 54, 56 are, for example, determined in accordance with a magnetic flux density (magnetic field intensity) of the induction heating coil 52.

[Center Core]

The center core 58 is, for example, a ferrite core having a tubular or cylindrical shape. Substantially similar to the heat roller 46, the center core 58 has a length corresponding to the maximum paper width (width of maximum size sheet out of sheets conveyed by the fixing unit 14). Although not shown in FIG. 2, the center core 58 is coupled to a rotating mechanism (see FIGS. 8A and 8B) and made rotatable about its longitudinal axis by this rotating mechanism. The rotating mechanism is described later.

The center core 58 is arranged between a pair of the arch cores 54 and the heat roller 46 (heating belt 48), when seen in a direction in which a magnetic field is generated by the induction heating coil 52, in order to form magnetic paths together with the arch cores 54 and the side cores 56. More specifically, ends 54*a* (entrances or exits of the magnetic paths) of the arch cores 54 are distant from the heating belt 48, but the center core 58 is a member for forming intermediate magnetic paths between the ends 54*a* and the heating belt 48.

[Temperature Controller]

In the example of FIG. 2, a temperature controller includes a thermistor 62 (temperature responding element) and a temperature control circuit 621. The thermistor 62 is disposed inside the heat roller 46 to detect the temperature of the heat roller 46. One or more thermistors 62 can be disposed at positions in the heat roller 46 where the amount of heat generation by induction heating is particularly large. In the construction of the first embodiment, the thermistor 62 is desirably disposed at an inner side facing a longitudinal central position (in a later-described area of a minimum paper width W1 shown in FIGS. 6A and 6B) of the heat roller 46.

The temperature control circuit 621 provided in the image forming apparatus 1 controls a power supply device 521 of alternating current power supplied to the induction heating coil 52 based on the temperature detected by the thermistor 62. The temperature control circuit 621 controls the alternating current power supplied from the power supply device 521 to the induction heating coil 52 such that a temperature T detected by the thermistor 62 is maintained at a target temperature Ta necessary to fix a toner image to a sheet. This control may be performed by on-off controlling the power supply device 521. Alternatively, a control to be executed may be such that the amount of alternating current power supplied to the induction heating coil 52 is increased and decreased by changing the voltage and/or frequency of the alternating current power generated by the power supply device 521.

One or more unillustrated thermostats (temperature responding elements) may be disposed inside the heat roller 46. The thermostats can be disposed at positions in the heat roller 46 where the amount of heat generation by induction heating is particularly large and operate in response to an excessive temperature increase of the heat roller 46 to stop the heating by the induction heating coil 52.

[Shielding Member]

The center core 58 has an outer surface on which a shielding member 60 is mounted. The shielding member 60 may be employed in the number of two, each of which is mounted on one of the opposite ends of the center core 58. Each shielding member 60 is in the form of a thin plate and is curved to have an arcuate shape in conformity with the shape of the outer surface of the center core 58. The shielding members 60 may be, for example, embedded in the center core 58 as shown or may be attached to the outer surface of the center core 58. The shielding members 60 can be bonded, for example, using a silicon adhesive. In the fixing unit 14 of the first embodiment, the shielding members 60 constitute a magnetic shielding body together with the center core 58.

The material of the shielding members 60 is preferably nonmagnetic and good in electrical conductivity. For example, oxygen-free copper or the like is used. The shielding member 60 generates opposing magnetic field by the influence of induction current induced when a magnetic field perpendicular to a surface of the shielding member 60 penetrates the surface of the shielding member 60, and then cancel interlinkage flux (perpendicular penetrating magnetic field) to thereby shield the magnetic field. Further, by using a good electrically conductive material, the generation of Joule heat by the induction current is suppressed and the magnetic field can be efficiently shielded. In order to improve electrical conductivity, it is effective, for example, to select a material with as small a specific resistance as possible and to increase the thickness of the members. Specifically, it is preferable to select the thickness of the shielding members 60 in a range of 0.5 mm to 3 mm and the shielding members 60 having a thickness of 1 mm are, for example, used in this embodiment. In this way, the specific resistance of the shielding members 60 can be made sufficiently small and a magnetic shielding effect can be obtained sufficiently, while the shielding members 60 can be made lighter.

[Magnetism Adjusting Member]

In the IH coil unit 50, magnetism adjusting members 90 are provided between the induction heating coil 52 and the heat roller 46 (the heating belt 48) and at the opposite sides of the center core 58. In FIG. 2, each of the magnetism adjusting members 90 is arranged at a position overlapping with the winding area of the induction heating coil 52. Each of these magnetism adjusting members 90 is made of a nonmagnetic metal (e.g. oxygen-free copper) and has a closed frame in rectangular shape or rectangular ring in a plan view. Because of their closed frame shape, inner sides of the magnetism adjusting members 90 are hollow and thus only ends thereof are shown in the section of FIG. 2. As shown in FIG. 2, the magnetism adjusting members 90 are arcuately curved as a whole. The center of curvature of each magnetism adjusting member 90 substantially coincides, for example, with the center of rotation of the heat roller 46, and the radius of curvature thereof is smaller than that of the imaginary arcuate surface where the induction heating coil 52 is arranged.

Figure 3:
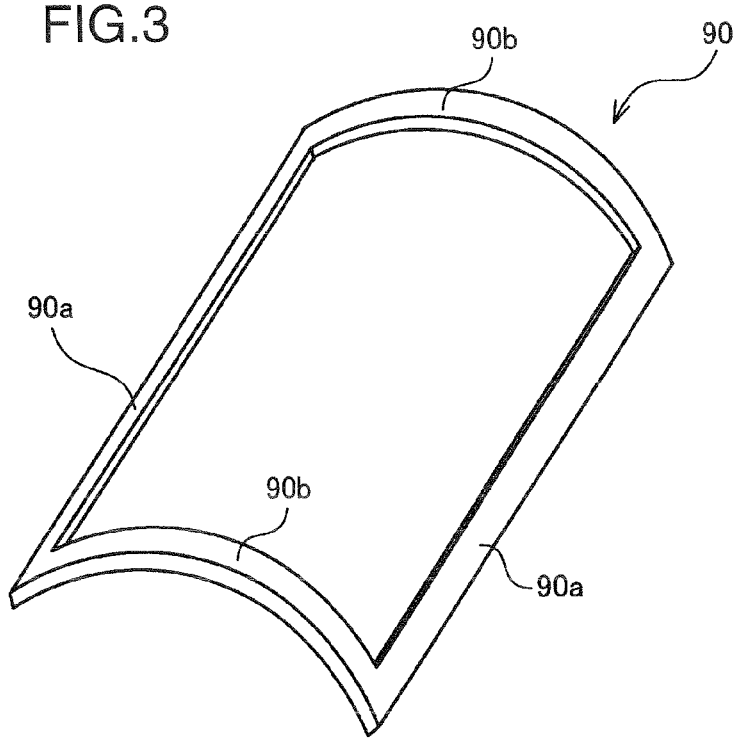
FIG. 3 is a perspective view showing a first structure example of a magnetism adjusting member.

FIG. 3 is a perspective view showing a first structure example of the magnetism adjusting member 90. The magnetism adjusting member 90 is of a rectangular frame shape or rectangular ring shape as a whole, and four sides thereof include a pair of straight portions 90*a* facing in a width direction thereof and a pair of arcuate portions 90*b* facing in a longitudinal direction thereof. Although only one magnetism adjusting member 90 is shown in FIG. 3, the IH coil unit 50 includes, for example, two magnetism adjusting members 90 at each of the opposite longitudinal ends of the heating belt 48, a total of four magnetism adjusting members 90. The magnetism adjusting members 90 are bonded (fixed) to the inner surface of the resin cover (on which the induction heating coil 52 is arranged in a wound manner).

Figure 4:
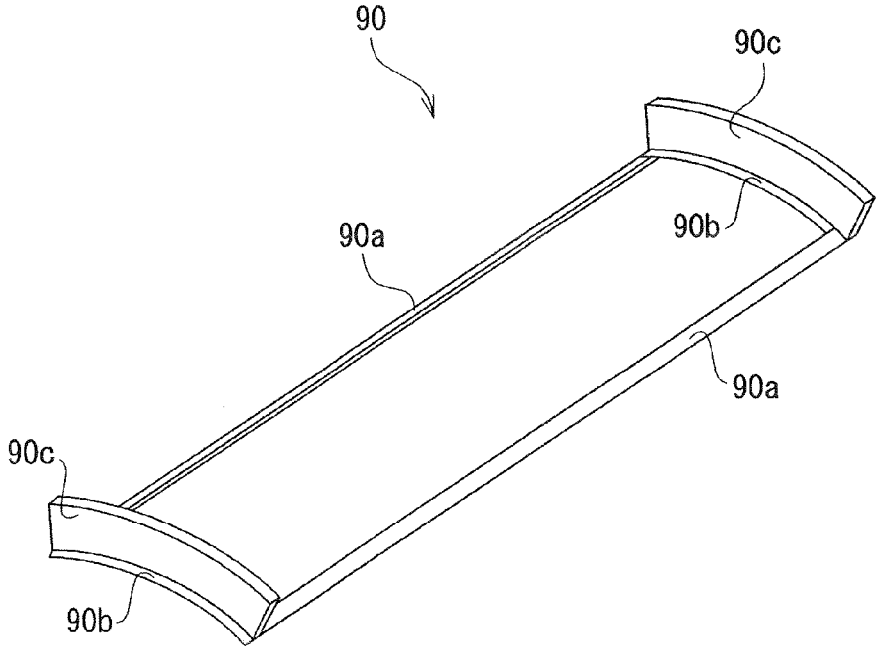
FIG. 4 is a perspective view showing a second structure example of the magnetism adjusting member.

FIG. 4 is a perspective view showing a second structure example of the magnetism adjusting member 90. In this structure example, flange portions 90*c* are formed on the pair of arcuate portions 90*b*. Thus, the cross section of the magnetism adjusting member 90 is increased in a circumferential direction thereof to increase rigidity as a whole and to make electrical resistance smaller. Flange portions may be formed on the pair of straight portions 90*a*.

[Characteristics of the Magnetism Adjusting Member]

Figure 5A:
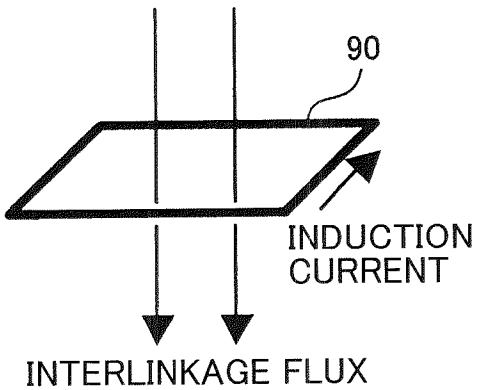
FIGS. 5A to 5C are conceptual diagrams explaining characteristics of the magnetism adjusting member.
Figure 5B:
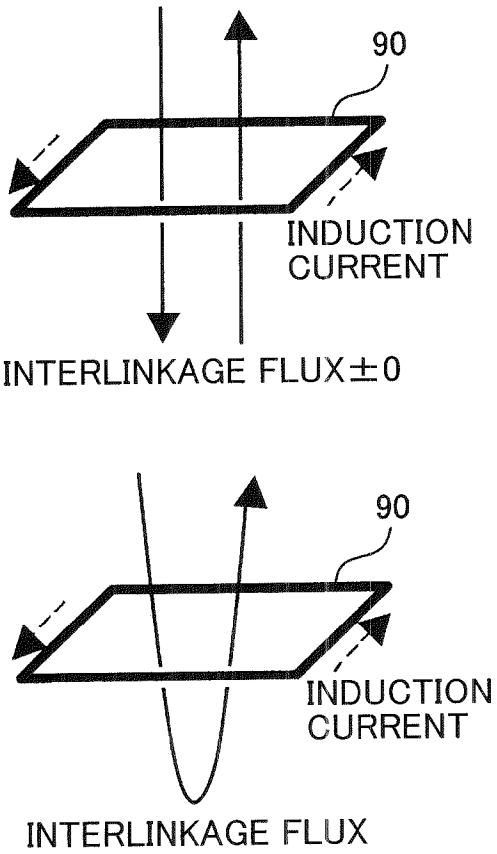
Figure 5C:
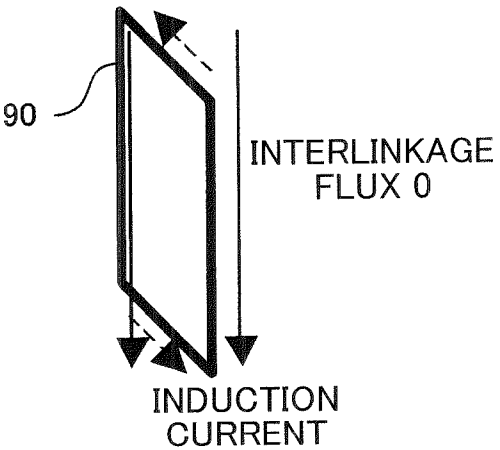

FIGS. 5A to 5C are conceptual diagrams explaining characteristics of the magnetism adjusting member 90. In FIGS. 5A to 5C, the magnetism adjusting member 90 is simply shown as a mere wire model.

If a penetrating magnetic field (interlinkage flux) is generated in a direction (one direction) perpendicular to a frame surface or ring surface (imaginary plane) of the frame-shaped magnetism adjusting member 90, an induction current is accordingly generated in a circumferential direction of the magnetism adjusting member 90 as shown in FIG. 5A. Then, a magnetic field (opposing magnetic field) acting in a direction opposite to the penetrating magnetic field is generated by electromagnetic induction, wherefore these magnetic fields cancel each other to eliminate the magnetic fields. In this embodiment, the magnetic shielding effect is compensated using this magnetic field canceling effect when the shielding members 60 are moved to a shielding position.

A case is assumed where penetrating magnetic fields are generated in both directions through the frame surface of the frame-shaped magnetism adjusting member 90 as shown in an upper part of FIG. 5B and the sum total of the interlinkage fluxes at this time are substantially zero (±0). In this case, substantially no induction current is generated in the magnetism adjusting member 90. Accordingly, the magnetism adjusting member 90 hardly exhibits its magnetic field canceling effect and the magnetic fields pass the magnetism adjusting member 90 in both directions. This similarly holds also in the case where a magnetic field passes the inner side of the magnetism adjusting member 90 in a U-turn direction as shown in a lower part of FIG. 5B. In this embodiment, the influence on magnetic fields is suppressed by fixedly arranging the magnetism adjusting members 90 at positions where the magnetic fields passing through the hollow parts of the magnetism adjusting members 90 are balanced when the shielding members 60 are moved to a retracted position.

FIG. 5C shows a case where a magnetic field (interlinkage flux) is generated substantially in parallel to the frame surface of the frame-shaped magnetism adjusting member 90. In this case as well, substantially no induction current is generated in the magnetism adjusting member 90, wherefore there is no magnetic field canceling effect. It should be noted that this pattern shown in FIG. 5C is not employed in this embodiment.

In view of the point that both an effect of shielding magnetism and an effect of not shielding magnetism can be obtained by states shown in FIGS. 5A and 5B, the arrangement of the magnetism adjusting members 90 at appropriate positions make it possible to enhance the magnetic shielding effect brought about by the shielding members 60 and also to prevent the magnetic field from being influenced when the shielding members 60 are retracted. Next, a magnetism shielding method using the shielding members 60 is first described.

[Magnetism Shielding Method]

When the shielding members 60 are located at positions (shielding position) proximate to the outer surface of the heating belt 48 as shown in FIG. 2, magnetic resistance increases around the induction heating coil 52 to reduce magnetic field intensity. On the other hand, if the center core 58 is rotated by 180° (rotation direction is not particularly limited) from the state shown in FIG. 2 and the shielding members 60 are moved to most distant positions (retracted position) from the heating belt 48, magnetic resistance decreases around the induction heating coil 52 and magnetic paths are formed through the arch cores 54 and the side cores 56 at the opposite sides of the center core 58 and the center core 58 as a center, whereby a magnetic field acts on the heating belt 48 and the heat roller 46.

Figure 6A:
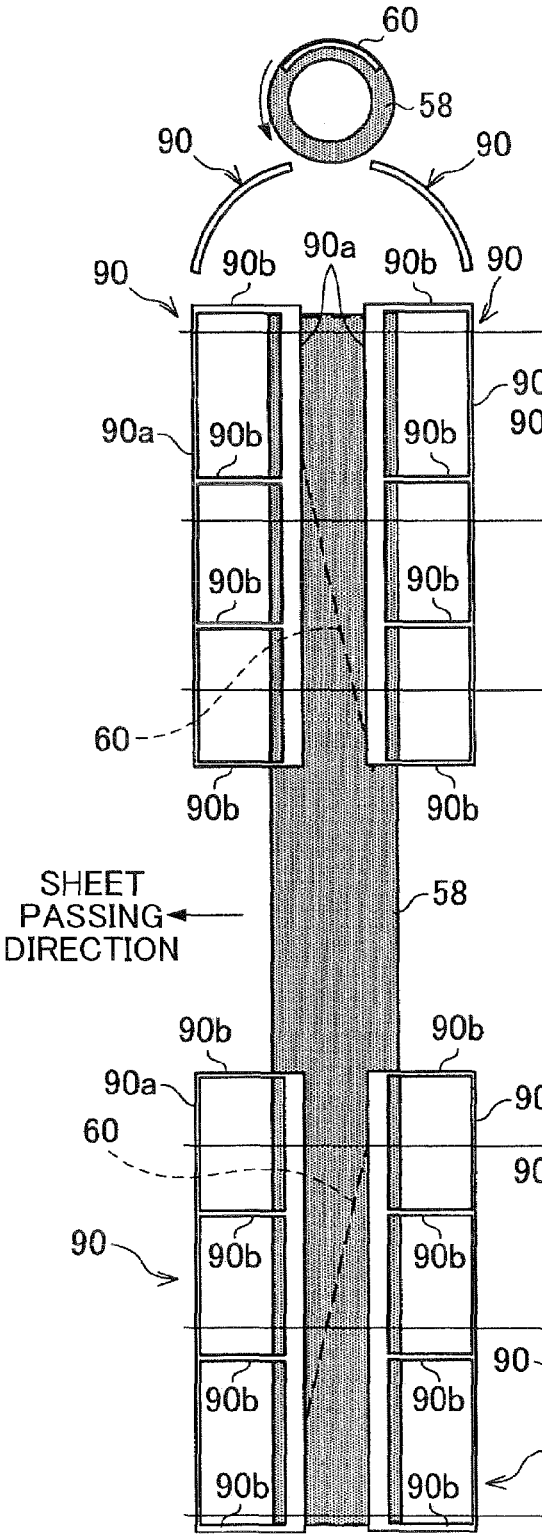
FIGS. 6A and 6B are diagrams showing an arrangement of a shielding member and the magnetism adjusting member.
Figure 6B:
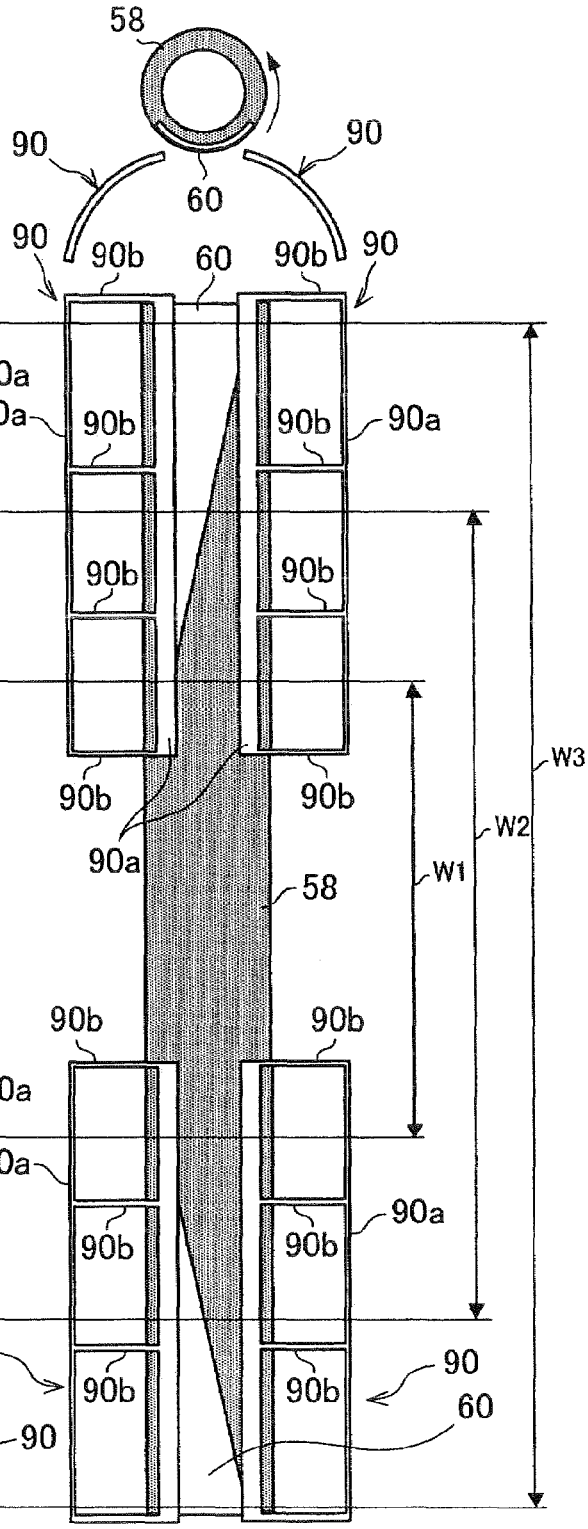

FIGS. 6A and 6B show an arrangement example of the shielding members 60 and the magnetism adjusting members 90. FIG. 6A shows the retracted position of the shielding members 60 and FIG. 6B shows the shielding position of the shielding members 60. Each of FIGS. 6A and 6B shows a side view and a bottom view of the center core 58 and the magnetism adjusting members 90. In FIGS. 6A and 6B, the outer surface of the center core 58 is shown by halftone dots.

As described above, the entire length of the center core 58 is substantially equal to or longer than a maximum sheet width W3 of sheets orthogonal to the sheet conveying direction. Two shielding members 60 are separated in the longitudinal direction of the center core 58 and are symmetrically shaped. Each shielding member 60 has, for example, a triangular shape in plan view or bottom view and a part thereof corresponding to the vertex of the triangular shape is located near the center of the center core 58. In other words, the lengths of the shielding members 60 in the circumferential direction of the center core 58 a shortest at the positions near the center of the center core 58 and the circumferential lengths of the shielding members 60 gradually increase from these positions toward the opposite ends of the center core 58.

Each of the shielding members 60 is provided in its most part outside the minimum paper width W1 orthogonal to the sheet conveying direction and only tiny part of the shielding member 60 is located within the range of the minimum paper width W1. Also, each of the shielding members 60 extends slightly beyond the maximum paper width W3 of sheets at the opposite ends of the center core 58. The minimum paper width W1 and the maximum paper width W3 are determined by sheets of the minimum size and the maximum size printable by the image forming apparatus 1. The size of sheet means a width orthogonal to the sheet conveying direction.

In this embodiment, a ratio of the length of each shielding member 60 to the outer circumferential length of the center core 58 in the rotating direction of the center core 58 differs in the longitudinal direction (lengthwise direction) of the center core 58. Here, if the ratio of the length (Lc) of each shielding member 60 to the outer circumferential length (L) of the center core 58 is a covering ratio (=Lc/L), the covering ratio is smaller at the inner side of the center core 58 and increases toward the outer sides (opposite ends) in the longitudinal direction. Specifically, the covering ratio is minimized in the vicinity of the minimum passage area (range of the minimum paper width W1) while being, conversely, maximized at the opposite ends of a maximum passage area, i.e. the center core 58 (range beyond the maximum paper width W3). The passage area means an area where a sheet comes into contact with the heating belt 48 when the sheet passes the heating belt 48 while being held between the pressure roller 44 and the fixing roller 45. In this passage area, a first area where the sheet does not come into contact with the heating belt 48 and a second area where the sheet comes into contact with the heating belt 48 are set according to the paper widths W1 to W3 of sheets. For example, when a sheet of the minimum paper width W1 is conveyed, a central part of the heating belt 48 is set as the second area and parts of the heating belt 48 near the opposite ends are set as the first area when viewed in the longitudinal direction of the heat roller 46. Further, when a sheet of the maximum paper width W3 is conveyed, a substantially entire part of the heating belt 48 is set as the second area when viewed in the longitudinal direction of the heat roller 46. In this case, no first area is set.

The respective sheet sizes can be dealt with by switching the positions of the shielding members 60 to partially suppress magnetic fluxes to be generated. At this time, excessive temperature increases can be prevented at the opposite ends of the heat roller 46 and the heating belt 48 by making an angle of rotation (rotational displacement amount) of the center core 58 differ according to the sheet size such that the larger the sheet size, the smaller the magnetic shielding amount and, conversely, the smaller the sheet size, the larger the magnetic shielding amount. Although only counterclockwise rotations are shown by arrows in FIGS. 6A and 6B, the center core 58 may be rotated clockwise. Further, the sheet conveying direction may be opposite to the one shown in FIG. 6A and 6B.

[Division of the Magnetism Adjusting Member]

In the example shown in FIGS. 6A and 6B, each magnetism adjusting member 90 has a rectangular frame shape as a whole, and the inside thereof is divided (sectioned) into a plurality of sections by the arcuate portions 90*b*. Thus, the magnetism adjusting member 90 has such a divided structure comprised of a plurality of closed frame parts when viewed in the longitudinal direction of the heating belt 48 (i.e. in a direction orthogonal to the sheet conveying direction). With such a structure in which one frame is divided into plurality of sections, the different paper widths W1, W2 and W3 differing according to the sheet sizes can be dealt with. For example, in the case of the minimum sheet size (minimum paper width W1), the magnetic shielding effect can be compensated by all the three frame parts of each magnetism adjusting member 90. In the case of a sheet size between the minimum and intermediate ones (minimum paper width W1 to intermediate paper width W2), the magnetic shielding effect can be compensated by the outer two frame parts of each magnetism adjusting member 90. In the case of the maximum sheet size (maximum paper width W3), an induction current is generated in none of the three frame parts of each magnetism adjusting member 90, thereby being able to eliminate the influence on the magnetic field generated by the induction heating coil 52.

[Modification of the Magnetism Adjusting Member]

Figure 7:
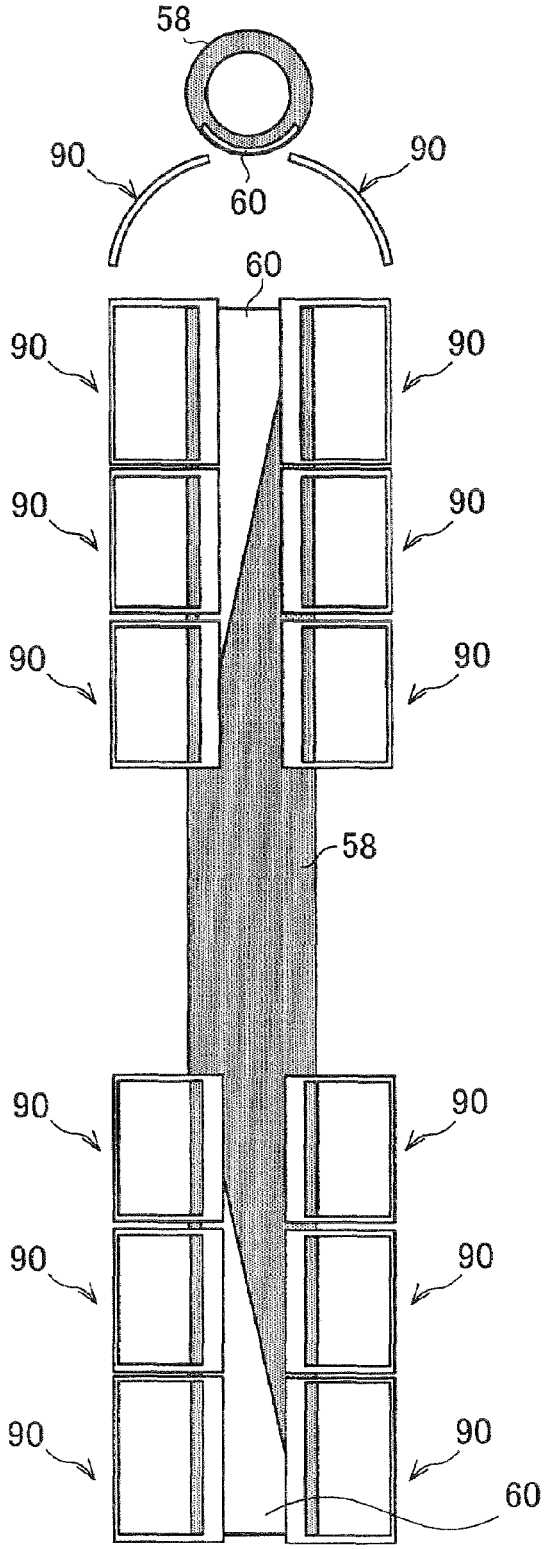
FIG. 7 is a diagram showing another arrangement of a modified magnetism adjusting member.

FIG. 7 is a diagram showing an arrangement example of modified magnetism adjusting members 90. The magnetism adjusting members 90 shown in FIG. 7 are individually and independently arranged in the direction orthogonal to the sheet conveying direction. Specifically, each of the magnetism adjusting members 90 is a single closed frame and is not electrically connected with others. In this case as well, the different paper widths W1, W2 and W3 differing according to the sheet sizes can be dealt with. For example, in the case of the minimum sheet size (minimum paper width W1), the magnetic shielding effect can be compensated by all the magnetism adjusting members 90. In the case of a sheet size between the minimum and intermediate ones (minimum paper width W1 to intermediate paper width W2), the magnetic shielding effect can be compensated by two outer magnetism adjusting members 90 (a total of eight). In the case of the maximum sheet size (maximum paper width W3), an induction current is generated in none of the magnetism adjusting members 90, thereby being able to eliminate the influence on the magnetic field generated by the induction heating coil 52.

[Rotating Mechanism for the Magnetic Shielding Members]

Figure 8A:
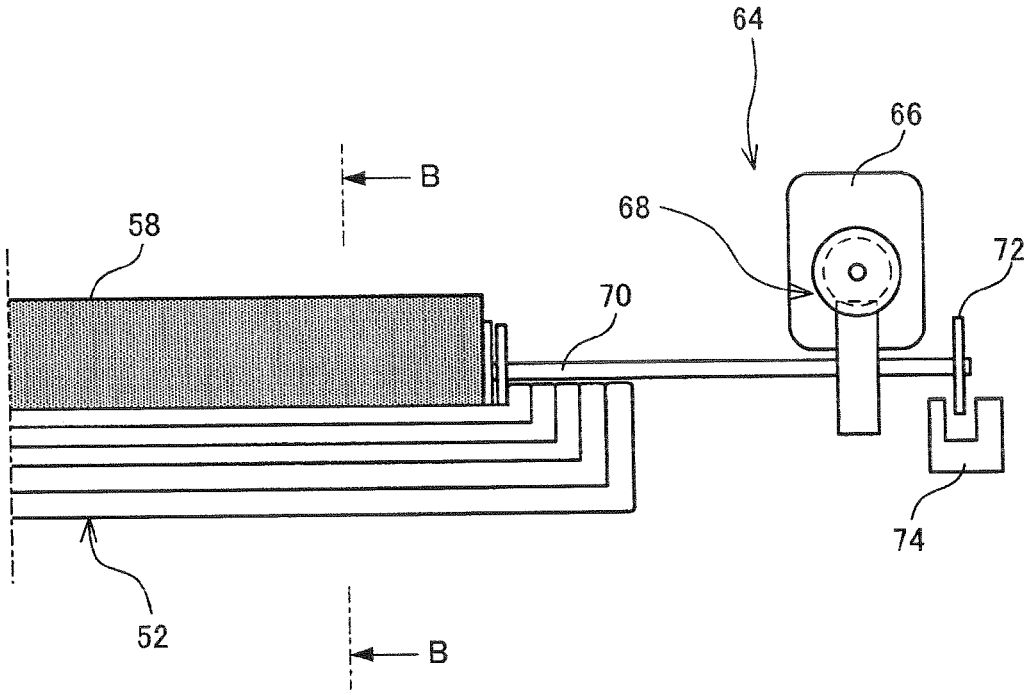
FIGS. 8A and 8B are a side view and a partial section showing the construction of a rotating mechanism, respectively.

Next, a mechanism for rotating the center core 58 about its longitudinal axis, i.e. a mechanism for displacing the shielding members 60 between the shielding position and the retracted position is described with reference to FIGS. 8A and 8B. FIG. 8A is a side view showing the construction of a rotating mechanism 64 for the center core 58 and FIG. 8B is a section along B-B of FIG. 8A.

Figure 8B:
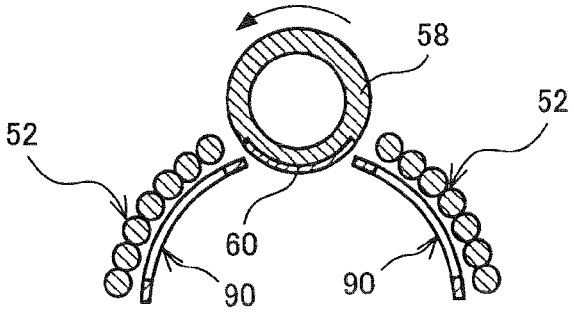

As shown in FIGS. 8A and 8B, the rotating mechanism 64 includes a stepping motor 66, a speed reducing mechanism 68 and a drive shaft 70. The rotating mechanism 64 reduces the rotating speed of the stepping motor 66 to a specified rotating speed by means of the speed reducing mechanism 68 and drives the drive shaft 70 to rotate the center core 58 about its longitudinal axis. The longitudinal axis of the center core 58 extends in a direction intersecting with a direction in which a magnetic field generated by the induction heating coil 52 passes the center core 58. A worm gear is, for example, used as the speed reducing mechanism 68, but something other than that may be used. A slitted disk 72 is provided at an end of the drive shaft 70 to detect the angle of rotation (rotational displacement amount from a reference position) of the center core 58, and a photointerrupter is combined therewith.

The drive shaft 70 is connected with one end of the center core 58, and supports the center core 58 without penetrating inside the center core 58. The angle of rotation of the center core 58 is controlled, for example, by the number of drive pulses applied to the stepping motor 66, and a control circuit (not shown) for this purpose is attached to the rotating mechanism 64. The control circuit may include, for example, a control IC, input/output drivers, a semiconductor memory and the like. A detection signal from the photointerrupter 74 is inputted to the control IC via the input driver and the control IC detects the present angle of rotation (position) of the center core 58 in accordance with this detection signal. On the other hand, information on the present sheet size is notified to the control IC from an unillustrated image forming controller. In response to this information, the control IC reads information on an angle of rotation suitable for the sheet size from the semiconductor memory (ROM) and outputs drive pulses necessary to reach this target angle of rotation in a specified cycle. The drive pulses are applied to the stepping motor 66 via the output driver and the stepping motor 66 accordingly operates.

Figure 9B:
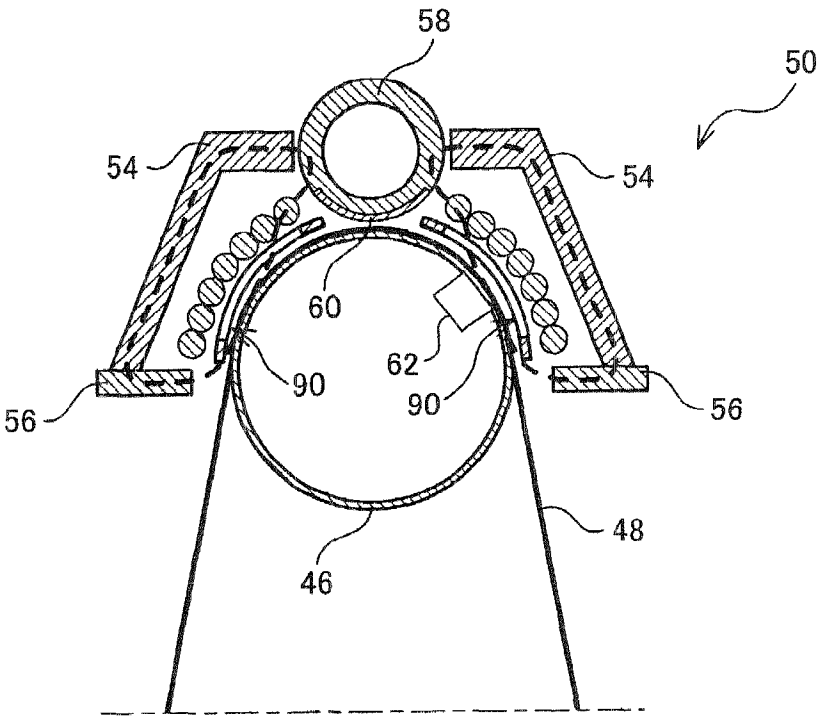
FIGS. 9A and 9B are diagrams showing operation examples associated with the rotation of a center core.
Figure 9A:
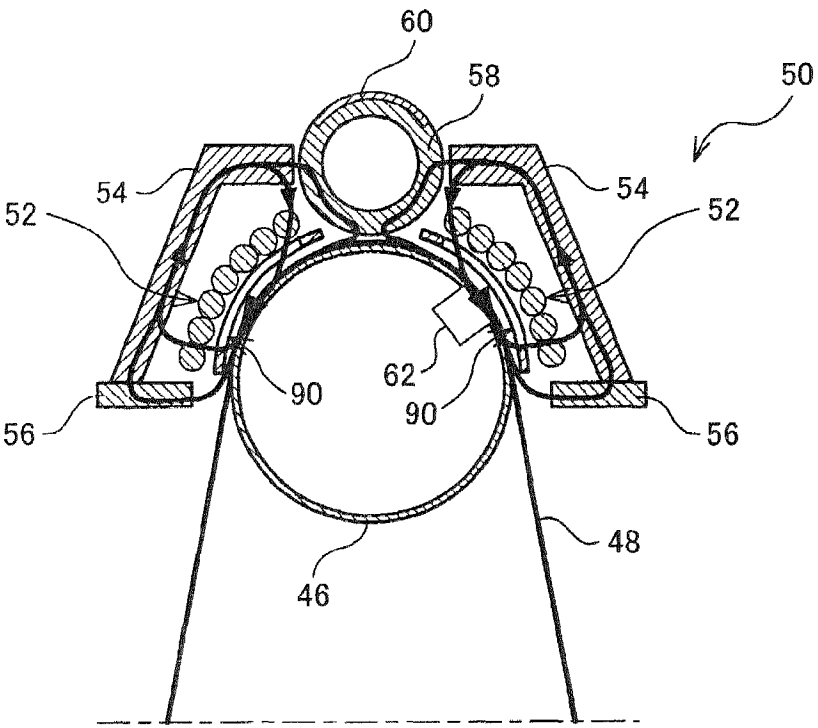

FIGS. 9A and 9B are diagrams showing operation examples associated with the rotation of the center core 58. They are respectively described below.

[Permitting State]

FIG. 9A shows an operation example in the case of switching the shielding members 60 to the retracted position as the center core 58 is rotated. In this case, the magnetic field generated by the induction heating coil 52 passes the heating belt 48 and the heat roller 46 via the side cores 56, the arch cores 54 and the center core 58. At this time, eddy currents are generated in the heating belt 48 and the heat roller 46 as ferromagnetic bodies, and Joule heat is generated by the specific resistances of the respective materials for heating.

[Function I of the Magnetism Adjusting Members]

At this time, at the inner sides of the magnetic paths passing the heating belt 48 and the heat roller 46 via the side cores 56, the arch cores 54 and the center core 58, magnetic fluxes leaking, for example, from the arch cores 54 pass the insides of the frame parts of the magnetism adjusting members 90, pass the heating belt 48 and the heat roller 46 and are converged to the arch cores 54 after passing the insides of the frame parts of the magnetism adjusting members 90 again.

Such leaking magnetic fluxes do not pass the center core 58 and the side cores 56, but contribute to induction heating the heating belt 48 and the heat roller 46 at the inner sides of the magnetic paths.

For such leaking magnetic fluxes, the magnetism adjusting members 90 are in the state shown in the lower part of FIG. 5B. In other words, since the magnetic field passes in a U-turn direction inside the frame parts of the magnetism adjusting members 90, the magnetism adjusting members 90 permit the passage of the leaking magnetic fluxes without fulfilling the function of canceling the leaking magnetic fluxes (second state). This can contribute to the shortening of the warm-up time without hindering the induction heating of the heating belt 48.

[Shielding State]

FIG. 9B shows an operation example in the case of switching the shielding members 60 to the shielding position. In this case, since the shielding members 60 are located on the magnetic paths outside the minimum paper area, the generation of the magnetic field is partially suppressed. In this way, the amount of heat generation outside the minimum paper area is suppressed and excessive temperature increases of the heating belt 48 and the heat roller 46 can be prevented. Further, by changing the angle of rotation of the center core 58 little by little, the magnetic field shielding amount can be adjusted. For example, if the angle of rotation of the center core 58 is increased in the counterclockwise direction from the position of FIG. 9B, no shielding is performed at the left side of the heating belt 48 and the heat roller 46. 9B and the magnetic field is generated, but the magnetic field continues to be shielded at the right side of the heating belt 48 and the heat roller 46. In this case, the intensity of the generated magnetic field is reduced as a whole as compared to the one at the position of FIG. 9A, wherefore the amount of heat generation can be reduced by that much.

[Functions II of the Magnetism Adjusting Members]

At this time, the magnetic paths passing the heating belt 48 and the heat roller 46 via the side cores 56, the arch cores 54 and the center core 58 are shielded but, at the inner sides thereof, magnetic fluxes leaking, for example, from the arch cores 54 try to pass the heating belt 48 and the heat roller 46 after passing the insides of the frame parts of the magnetism adjusting members 90. If the heating belt 48 and the heat roller 46 are induction heated by such leaking magnetic fluxes, the shielding effect by the shielding members 60 is reduced.

In this embodiment, in the shielding state, the magnetism adjusting members 90 are in the state shown in FIG. 5A for magnetic fluxes trying to leak from the arch cores 54. In other words, since the leaking magnetic fluxes become interlinkage fluxes inside the frame parts of the magnetism adjusting members 90, the magnetism adjusting members 90 can fulfill the function of canceling the leaking magnetic fluxes and suppress the passage of the leaking magnetic fluxes (first state). Since the magnetism adjusting members 90 can compensate for the shielding effect by the shielding members 60 in this way, a sufficient magnetic shielding effect can be obtained even without enlarging the areas of the shielding members 60 and excessive temperature increases of the heating belt 48 and the heat roller 46 can be more suppressed than at present.

The magnetic shielding body constituted by the shielding members 60 and the center core 58 acts as a switcher for switching the magnetism adjusting members 90 to the first state in which the magnetism adjusting members 90 fulfill the magnetic shielding effect when the shielding members 60 are at the shielding position and to the second state in which the magnetism adjusting members 90 do not fulfill the magnetic shielding effect when the shielding members 60 are at the retracted position.

[Condition Setting]

Next, condition setting found out by the inventors of the present invention is described by way of examples. The magnetism adjusting members 90 are preferably made of a material which is nonmagnetic and good in electrical conductivity in order to suppress the generation of Joule heat by the induction current and to efficiently shield magnetism in the case of compensating for the magnetic shielding effect by the shielding members 60 as described above. In this embodiment, oxygen-free copper or the like material is used as described above. In order to improve electrical conductivity, it is necessary to select a material with as small a specific resistance as possible and to increase the thickness (t in FIG. 10) of the material. According to conditions found out by the inventors of the present invention, the thickness t of the magnetism adjusting members 90 is preferably set in a range of 0.5 mm to 3 mm.

Figure 10:
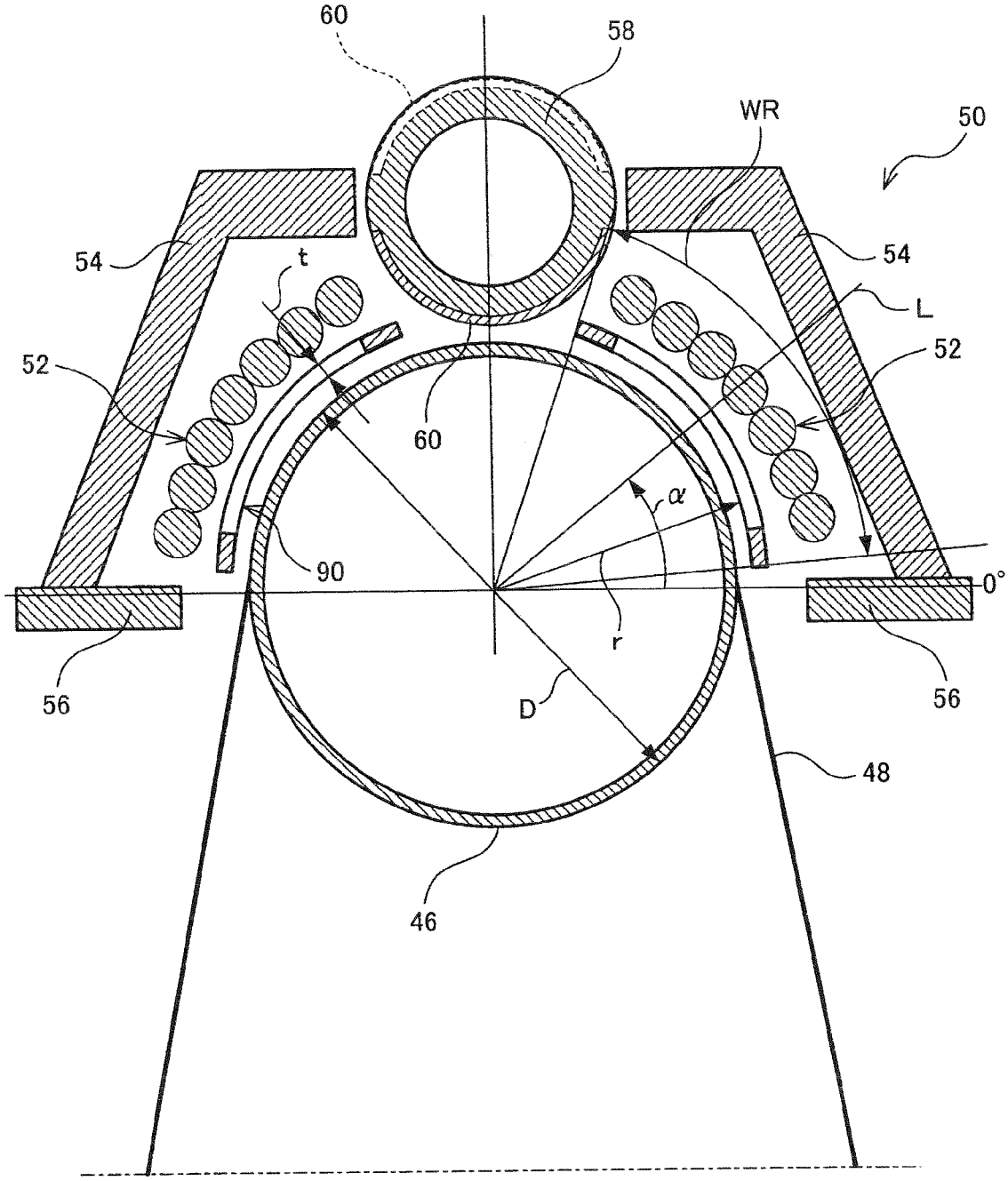
FIG. 10 is a diagram showing various conditions set in the fixing unit according to the first embodiment.

FIG. 10 is a diagram showing various conditions set in this embodiment. The following conditions are presented by the inventors of the present invention for an angle ($\alpha$ in FIG. 10) at which the magnetism adjusting members 90 are set with respect to the heating belt 48 and the heat roller 46. For example, a horizontal line passing the axial center of the heat roller 46 as a center (horizontal line in FIG. 10, different from an actually mounted state) is assumed to represent a reference angle (=0°). If an angle (°) of a frame center L of the magnetism adjusting member 90 is set in a counterclockwise direction from the center, optimal conditions can be set for the arrangement angle $\alpha$ of the magnetism adjusting member 90 and a frame width WR based on the following idea.

Figure 11:
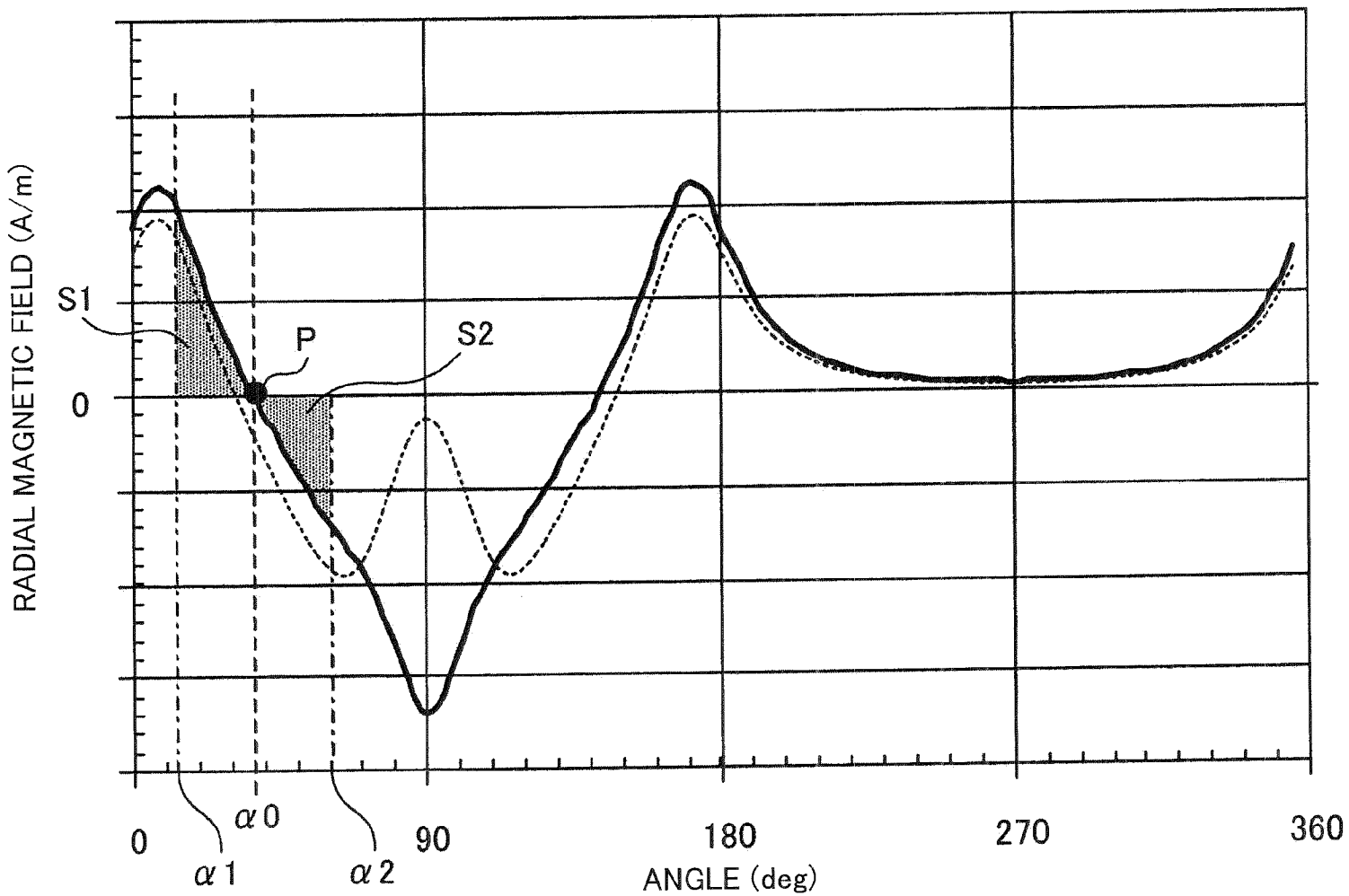
FIG. 11 is a graph showing distribution curves representing intensity distribution of a radial magnetic field when viewed around a heat roller (360°).

FIG. 11 is a graph showing distribution curves representing intensity distributions of a radial magnetic field around (360°) the heat roller 46. In FIG. 11, a horizontal axis represents angle (°) in the counterclockwise direction from the above reference angle (=0°) and a vertical axis represents, for example, the radial magnetic field (A/m). A thick-line curve shown in FIG. 11 represents a distribution when no magnetic shielding by the shielding members 60 is performed (retracted position). A dotted-line curve shown in FIG. 11 represents a distribution when the magnetic shielding by the shielding members 60 is performed (shielding position). At this time, the magnetism adjusting members 90 are preferably so arranged as not to influence the magnetic field when no magnetic shielding is performed.

Accordingly, if it is assumed that the shielding members 60 are displaced to the retracted position and the magnetic field canceling effect is not exhibited (thick-line distribution in FIG. 11), it can be understood that the intensity of the radial magnetic field has peaks near 0°, 90° and 180° and almost no magnetic field is generated near 270° (right below) where the induction heating coil 52 is not arranged.

In such a magnetic field distribution, a point P where the radial magnetic field becomes 0 on the distribution curve is first taken and angles $\alpha$1, $\alpha$2 where integration values of the distribution curves in directions toward 0° and 90° from this point P are equal (areas S1, S2 in FIG. 1 are equal) are calculated. If the magnetism adjusting member 90 is arranged in this calculated angle range of $\alpha$1 to $\alpha$2, the magnetic field is balanced out at 0 by the magnetism adjusting member 90 when no magnetic shielding is performed, with the result that the magnetic field is not hindered.

Then, an angle (=($\alpha$1+$\alpha$2)/2) as a midpoint of the angles $\alpha$1, $\alpha$2 on the horizontal axis is calculated and set as an angle of the frame center L at the retracted position. If a distance from the center of the heat roller 46 to the magnetism adjusting member 90 is a radius r, the length of a virtual arc having this radius r and located in the angle range of $\alpha$1 to $\alpha$2 is an optimal frame width of the magnetism adjusting member 90. In this example, the frame width WR can be calculated by the following equation. It should be noted that the radius r is larger than the radius (D/2 in FIG. 11) of the heat roller 46.

$$WR=r\times\{(\alpha 2-\alpha 1)/180\}\times\pi$$

By setting the frame width of the magnetism adjusting members 90 to WR (above equation) and setting the arrangement angle of the frame centers to ($\alpha$2−$\alpha$1)/2 as described above, optimal conditions can be set. Particularly, since the magnetic field is balanced out (areas S1=S2) insides the frame parts with the shielding members 60 switched to the retracted position, there is no likelihood of hindering the generation of the magnetic field by the induction heating coil 52. In the first embodiment, the frame width WR is preferably selected from a range of 1 mm to 5 mm. The selection of the frame width WR in such a range contributes to making the specific resistance of the magnetism adjusting member 90 sufficiently small. The frame width WR means a distance between a pair of straight portions 90*a*, 90*a* of the magnetism adjusting member 90.

Hereinafter, first to fourth modifications of the fixing unit 14 of the first embodiment are described. In any of these modifications, constructions common to the first embodiment are identified and shown by common reference numerals and not repeatedly described. Even with common reference numerals given, description is added particularly in the case of using different materials and the like.

First Modification

Figure 12:
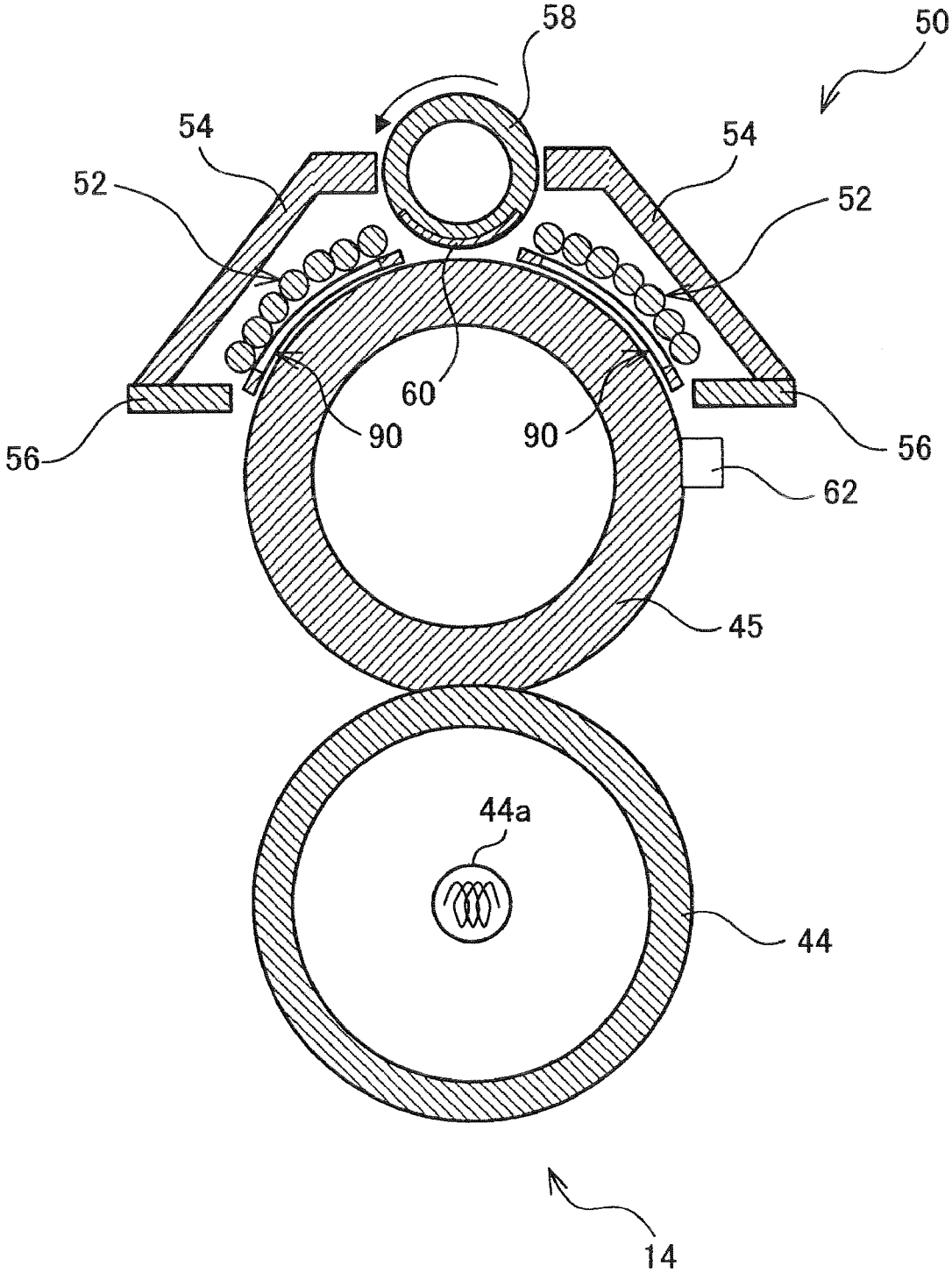
FIG. 12 is a diagram showing a first modification of the fixing unit according to the first embodiment.

FIG. 12 is a diagram showing the first modification of the fixing unit 14 of the first embodiment. In this first modification, a toner image is fixed by the fixing roller 45 and the pressure roller 44 without using the heating belt 48 and the heat roller 46. A magnetic body similar to the above heating belt is, for example, wound around the outer circumferential surface of the fixing roller 45, and the magnetic body is induction heated by the induction heating coil 52. In this case, the thermistor 62 is disposed at a position outside the fixing roller 45 to face a layer of the magnetic body. The rest is similar to the above and the magnetic shielding amount can be adjusted by rotating the center core 58. The magnetism adjusting members 90 are arranged between the induction heating coil 52 and the fixing roller 45.

Second Modification

Figure 13:
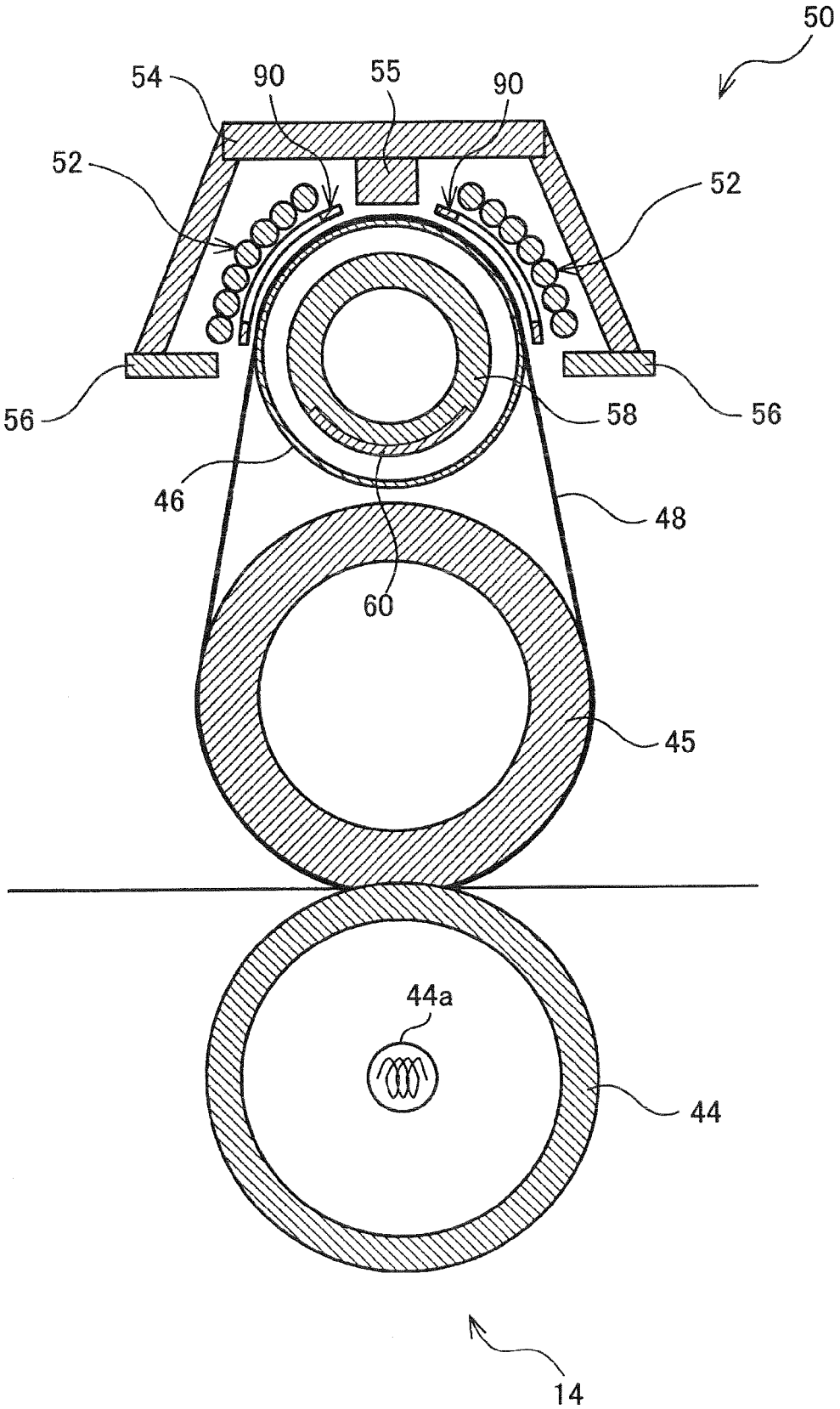
FIG. 13 is a diagram showing a second modification of the fixing unit according to the first embodiment.

FIG. 13 is a diagram showing the second modification of the fixing unit 14 of the first embodiment. This second modification differs from the first modification in that the heat roller 46 is made of a nonmagnetic metal material (e.g. SUS: stainless steel) and the center core 58 is arranged inside the heat roller 46. In addition, the arch cores 54 are connected in the center and an intermediate core 55 is disposed below the arch cores 54. Further, the magnetism adjusting members 90 are arranged between the induction heating coil 52 and the heating belt 48.

If the heat roller 46 is made of the nonmagnetic metal, the magnetic field generated by the induction heating coil 52 passes the side cores 56, the arch cores 54 and the intermediate core 55 and passes through the heat roller 46 to reach the center core 58 inside. The heating belt 48 is induction heated by the penetrating magnetic field.

In the case of the second modification, the shielding members 60 are distanced from the intermediate core 55 at the retracted position as shown in FIG. 13 and, in this case, no magnetic shielding effect is exhibited to induction heat the heating belt 48 in the maximum paper area. On the other hand, if the shielding members 60 are switched to positions (shielding position) to face the intermediate core 55, magnetism is shielded to suppress excessive temperature increases outside the paper area.

Third Modification

Figure 14:
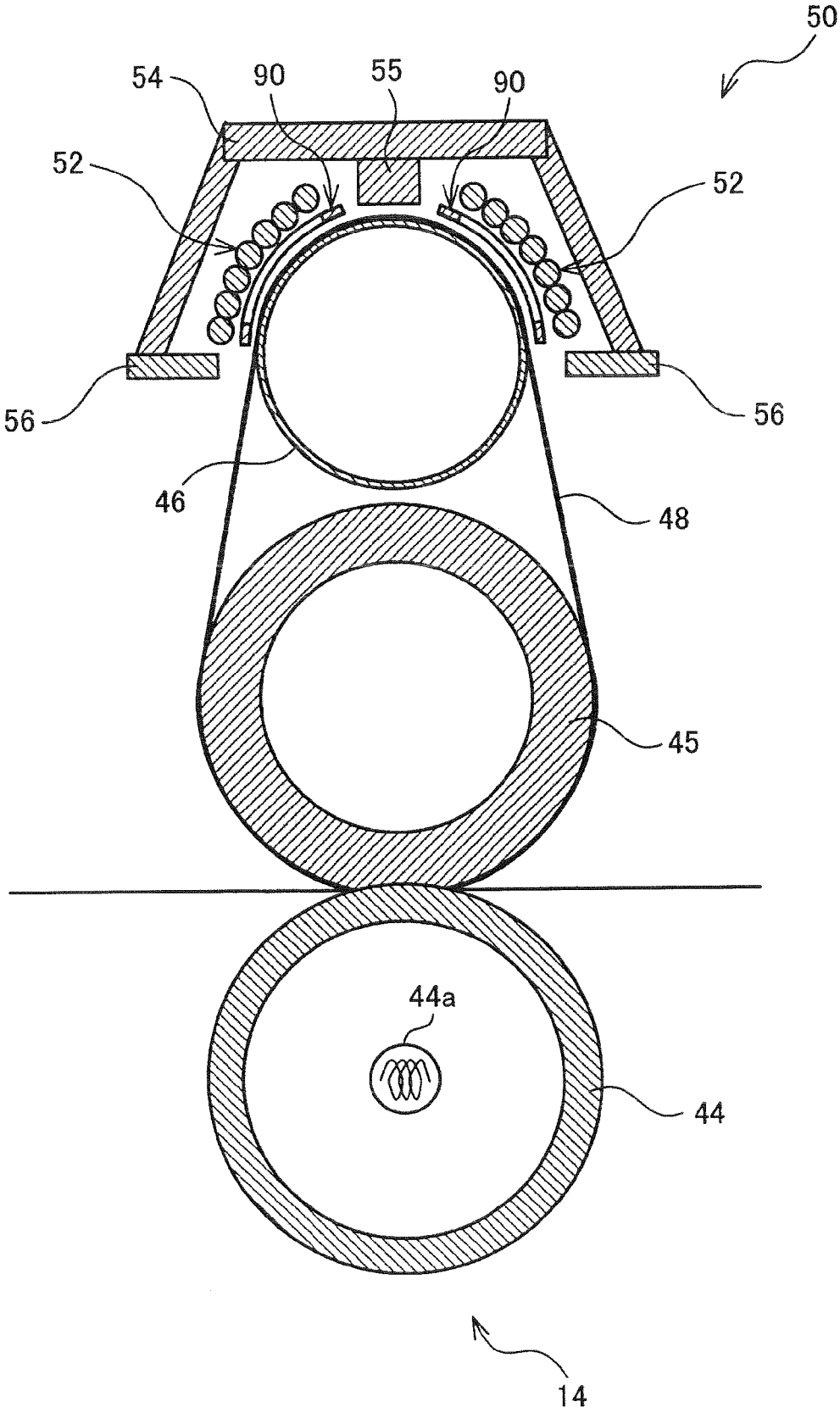
FIG. 14 is a diagram showing a third modification of the fixing unit according to the first embodiment.

FIG. 14 is a diagram showing the third modification of the fixing unit 14 of the first embodiment. This third modification differs from the first and second modifications in that the heat roller 46 is made of a magnetic shunt metal (e.g. iron-nickel alloy) and magnetism is shielded by a temperature change of the heat roller 46 itself. In other words, in the third modification, when the heat roller 46 is heated to or above a Curie temperature, magnetic property is lost to exhibit the magnetic shielding effect, wherefore an excessive temperature increase of the heat roller 46 itself can be prevented. On the other hand, while the heat roller 46 is heated in a range below the Curie temperature, magnetism is permitted by the magnetic property of the magnetic shunt metal. Thus, a toner image can be fixed by Joule heat from the heat roller 46. The magnetism adjusting members 90 are arranged between the induction heating coil 52 and the heating belt 48.

Since it is not necessary to provide the shielding members in the case of the third modification, the center core, on which the shielding members are arranged, and the rotating mechanism therefor are not necessary, either. Therefore, the structure can be simplified.

Fourth Modification

Figure 15:
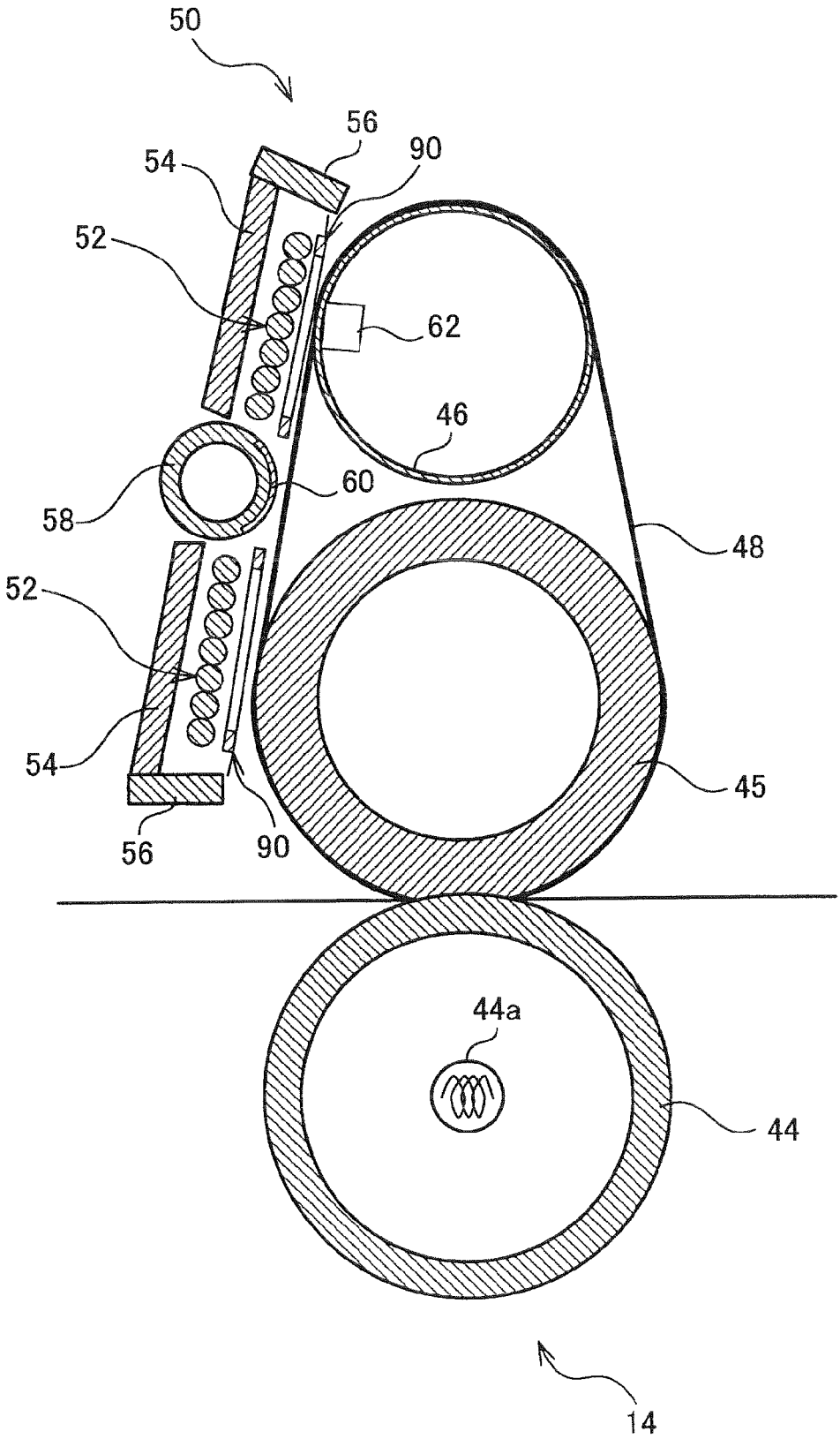
FIG. 15 is a diagram showing a fourth modification of the fixing unit according to the first embodiment.

FIG. 15 is a diagram showing the fourth modification of the fixing unit 14 of the first embodiment. In this fourth modification, induction heating is performed not at an arcuate position of the heating belt 48, but at a flat position of the heating belt 48. In this case as well, a magnetism shielding amount can be similarly adjusted by rotating the center core 58. Further, the magnetism adjusting members 90 are flat frames and arranged between the induction heating coil 52 and the heating belt 48.

The first embodiment and the first to fourth modifications described above can be embodied while being variously modified. For example, the shape of the center core 58 is not limited to the tubular or cylindrical one and may be a polygonal shape. The shape of the shielding members 60 in plan view is not limited to the triangular shape, but may be a trapezoidal shape.

The shapes, sizes and number of the frame parts of the magnetism adjusting members 90 are merely examples and are particularly not limited.

Besides, the specific shapes of the respective parts including the arch cores 54 and the side cores 56 are not limited to the shown ones and can be appropriately changed.

Second Embodiment

Figure 16:
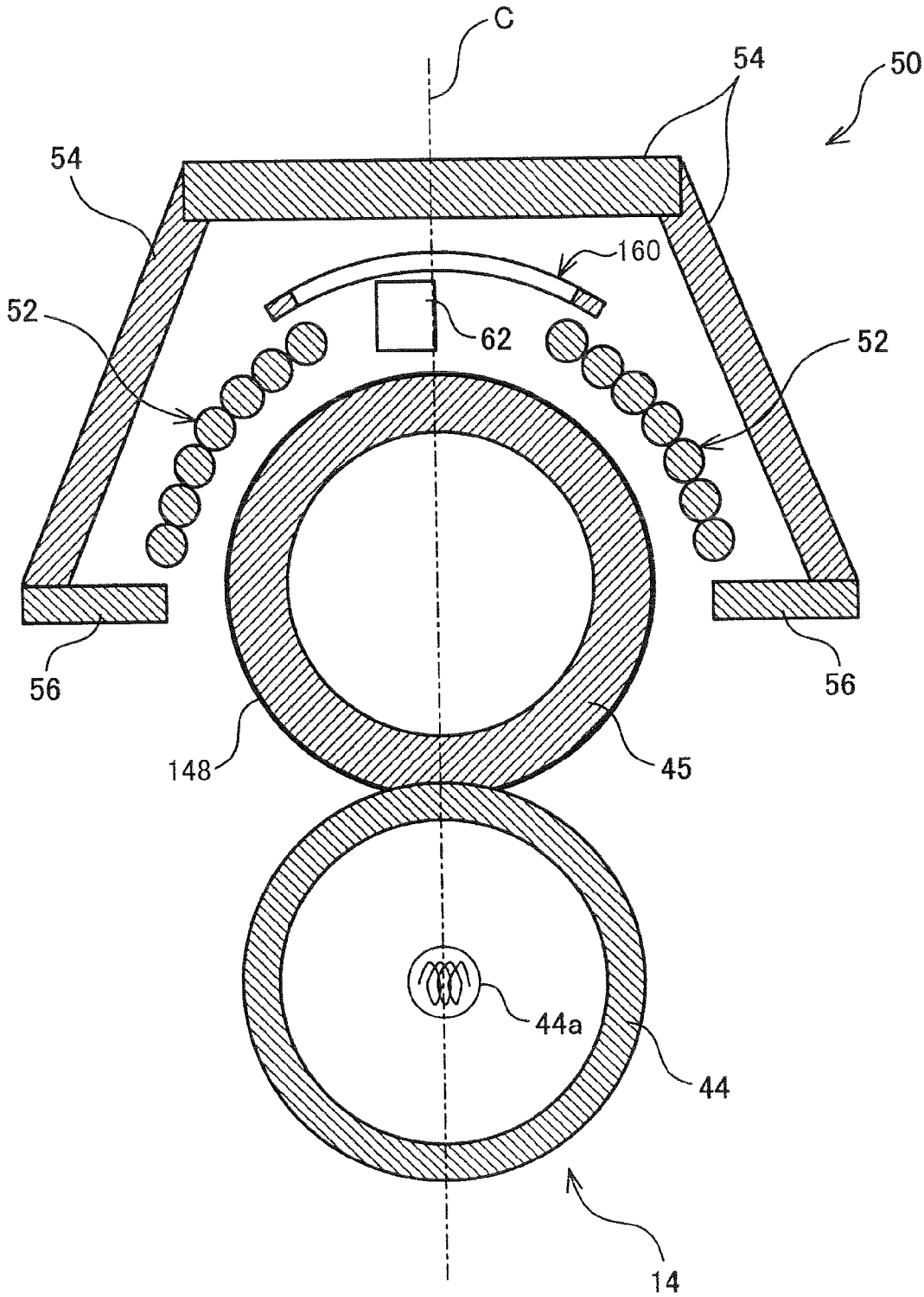
FIG. 16 is a vertical section showing a fixing unit according to a second embodiment of the invention.

Next, a fixing unit 14 according to a second embodiment is described in detail. FIG. 16 is a vertical section showing the fixing unit 14 of the second embodiment. In FIG. 16, the orientation of the fixing unit 14 is rotated counterclockwise by about 90° from an actually mounted state in the image forming apparatus 1. Accordingly, the sheet conveying direction from lower side to upper side in FIG. 1 is from right side to left side in FIG. 16. If the apparatus main body 2 has a larger size (complex machine or the like), the fixing unit 14 may be actually mounted in the orientation shown in FIG. 16.

The fixing unit 14 includes a pressure roller 44, a fixing roller 45 and a heating belt 148 wound around the fixing roller 45. The pressure roller 44 is a metallic roller, whereas the fixing roller 45 has an elastic layer of silicon sponge on its outer surface (at an inner side of the heating belt 148). Thus, a flat nip NP is formed between the heating belt 148 and the fixing roller 45. A halogen heater 44*a* is disposed inside the pressure roller 44. The base material of the heating belt 148 is a ferromagnetic material (e.g. Ni), a thin elastic layer (e.g. silicon rubber) is formed on the outer surface of the base material, and a mold releasing layer (e.g. PFA) is formed on the outer surface of the elastic layer.

The fixing unit 14 further includes an IH coil unit 50 arranged at an outer side of the fixing roller 45 (heating belt 148). The IH coil unit 50 includes an induction heating coil 52, arch cores 54 and a pair of side cores 56. These arch cores 54 and side cores 56 are magnetic bodies formed, for examples, by sintering ferrite powders. Although the arch cores 54 are three divided pieces here, they may be integrally formed.

As shown in FIG. 16, the induction heating coil 52 is arranged on an imaginary arcuate surface extending along an arcuate outer surface of the heat roller 46 (heating belt 148) so that the induction heating coil 52 can perform induction heating to the arcuate surface of the heat roller 46 (heating belt 148). Actually, an unillustrated resin cover is arranged at the outer side of the fixing roller 45 (heating belt 148) and the induction heating coil 52 is wound around this resin cover.

[Coil Center]

Although not shown here, the induction heating coil 52 is elliptically wound in plan view (state viewed from above in FIG. 16). In other words, the fixing roller 45 (heating belt 148) has a length sufficient to cover the maximum paper width of sheets and a magnetic field is generated substantially in its entire longitudinal area. Thus, the winding area of the induction heating coil 52 is slightly longer the entire length of the fixing roller 45. Accordingly, the induction heating coil 52 can induction heat substantially the entire longitudinal area of the fixing roller 45. On the other hand, in a section shown in FIG. 16, the magnetic field can be generated at a substantially upper half of the fixing roller 45. Accordingly, the induction heating coil 52 can induction heat substantially half the circumference in the circumferential direction of the fixing roller 45. Such an induction heating coil 52 is formed around the coil center (C in FIG. 16) in the section of FIG. 16, and the coil center substantially is aligned with the center line of the fixing roller 45. It should be noted that the "coil center" in the description of the second embodiment and a third embodiment described later means the center line (C) in the section of FIG. 16.

In this second embodiment, a thermistor 62 (may be a thermostat) is disposed to face the outer side of the fixing roller 45. The thermistor 62 can be arranged, for example, at a position where the intensity of the magnetic field generated by the induction heating coil 52 is high and the thermistor 62 does not interfere with the induction heating coil 52.

[Magnetism Adjusting Member]

The IH coil unit 50 includes magnetism adjusting members 160 located between the induction heating coil 52 and the arch cores 54. Each of the magnetism adjusting members 160 is made of a nonmagnetic metal (e.g. oxygen-free copper) and has a closed frame in rectangular shape in plan view. Because of its closed frame shape, the inner side of the magnetism adjusting member 160 is hollow and only an end thereof is shown in FIG. 16. The magnetism adjusting members 160 are arcuately curved as a whole. The centers of curvature of the magnetism adjusting members 160 substantially coincide, for example, with the center of rotation of the fixing roller 45, and the radius of curvature thereof is larger than that of the imaginary arcuate surface where the induction heating coil 52 is arranged and is large enough not interfere with the induction heating coil 52.

Figure 17:
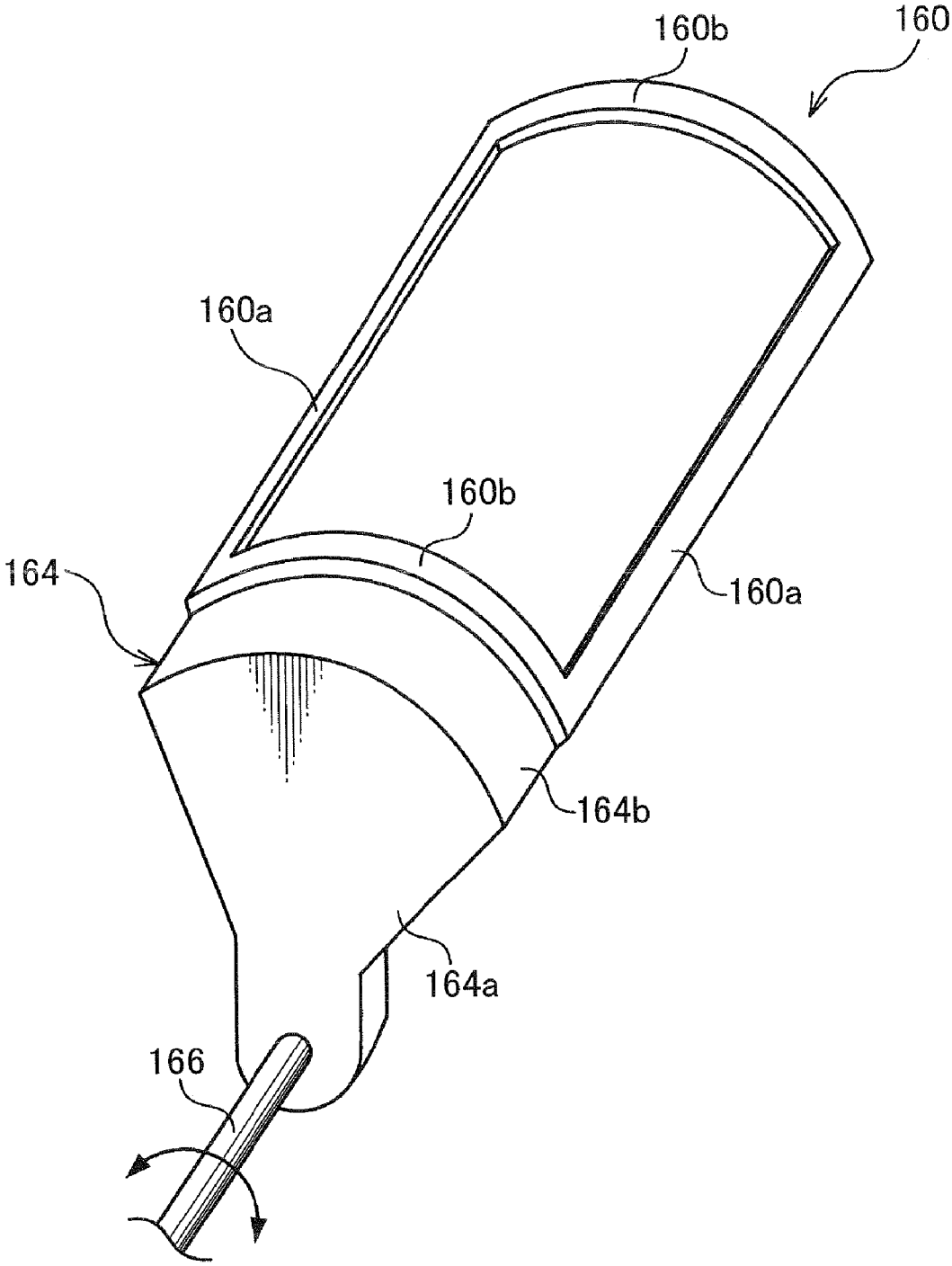
FIG. 17 is a perspective view showing a first structure example of a magnetism adjusting member in the second embodiment.

FIG. 17 is a perspective view showing a first structure example of the magnetism adjusting member 160. The magnetism adjusting member 160 has a rectangular frame shape as a whole, and four sides thereof include a pair of straight portions 160*a* facing in a width direction and a pair of arcuate portions 160*b* facing in a longitudinal direction.

[Magnetism Adjusting Mechanism]

A magnetism adjusting mechanism includes a supporting member 164 supporting the magnetism adjusting member 160, a drive shaft 164 mounted on the supporting member 164 and an unillustrated driving mechanism (stepping motor and speed reducing mechanism) connected to the drive shaft 166. The magnetism adjusting member 160 is supported at its longitudinal end by the supporting member 164. The supporting member 164 includes a side plate 164*a* having, for example, a fan shape and an arcuate top plate 164*b*, and the top plate 164*b* is mounted to the lower surface of one arcuate portion 160*b* of the magnetism adjusting member 160. The side plate 164*a* extends downward from the top plate 164*b* in FIG. 17, and the drive shaft 166 is mounted on the lower part of the side plate 164*a*. The magnetism adjusting mechanism can displace the magnetism adjusting member 160 in a rotating direction together with the supporting member 164 when the drive shaft 166 is rotated by the driving mechanism. In this way, the magnetism adjusting member 160 is moved to a shielding position and a retracted position to be described later.

Figure 18:
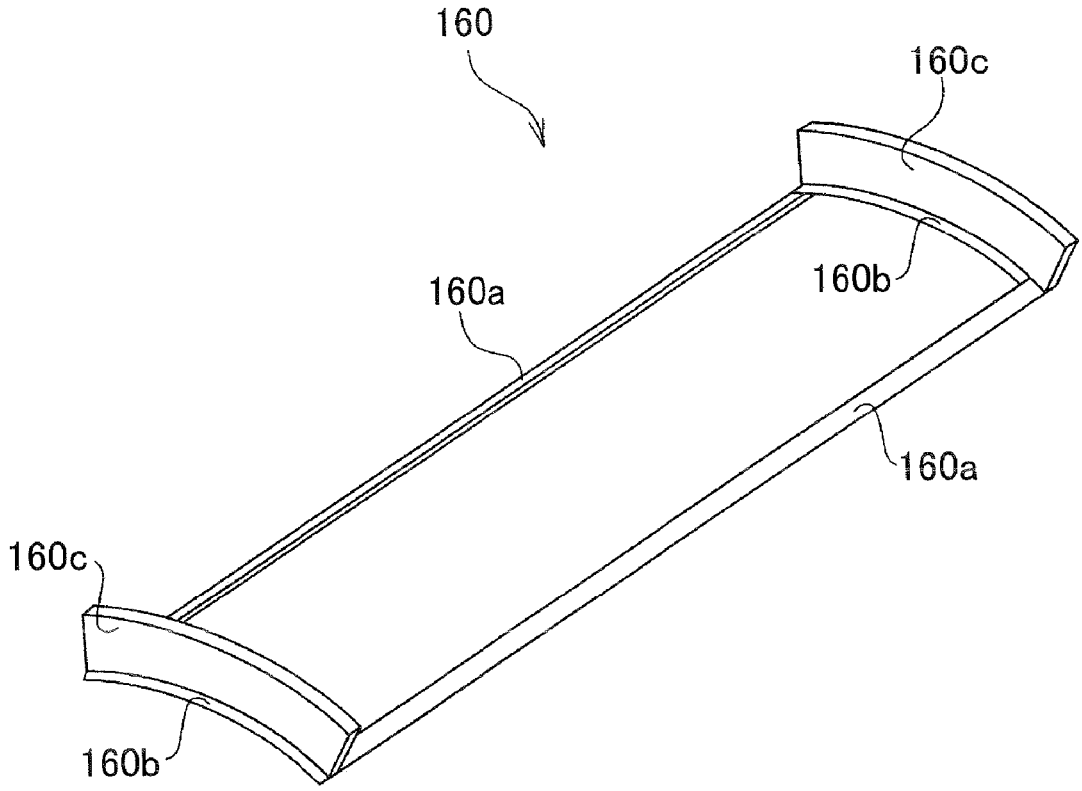
FIG. 18 is a perspective view showing a second structure example of the magnetism adjusting member in the second embodiment.

FIG. 18 is a perspective view showing a second structure example of the magnetism adjusting member 160. In this structure example, flange portions 160*c* are formed on the pair of arcuate portions 160*b*. Thus, the cross section of the magnetism adjusting member 160 in a circumferential direction can be increased to increase rigidity as a whole. Flange portions may be formed on the pair of straight portions 160*a*. Although not shown here, it is possible to support the magnetism adjusting member 160 by a supporting member similar to the one of the first structure example and to displace the magnetism adjusting member 160 by the magnetism adjusting mechanism.

[Principle of the Magnetic Shielding Effect]

Since the principle of the magnetic shielding effect by the magnetism adjusting member 160 is similar to that of the magnetic shielding effect by the magnetism adjusting member 90 described with reference to FIGS. 5A to 5C, it is not described in detail. In the second embodiment, an optimal magnetic adjustment is made by displacing the magnetism adjusting member 160 to the shielding position and the retracted position. An example of a magnetism adjusting method is described below.

[Example of the Magnetism Adjusting Method]

Figure 19B:
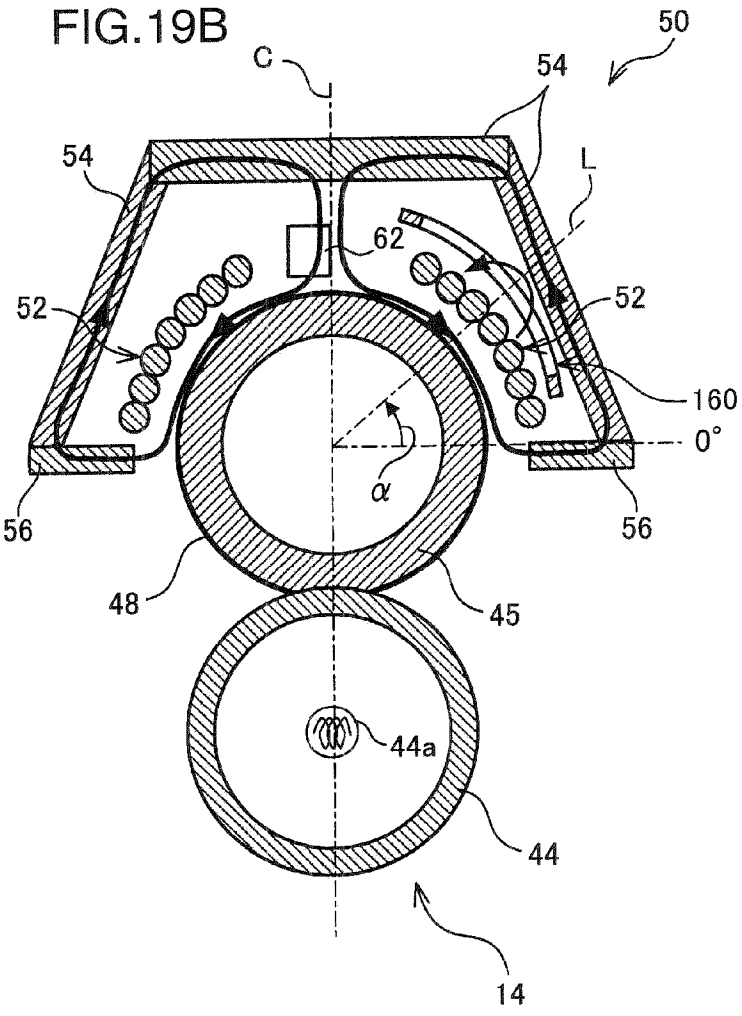
FIGS. 19A and 19B are diagrams showing a magnetism adjusting method using the magnetism adjusting member.
Figure 19A:
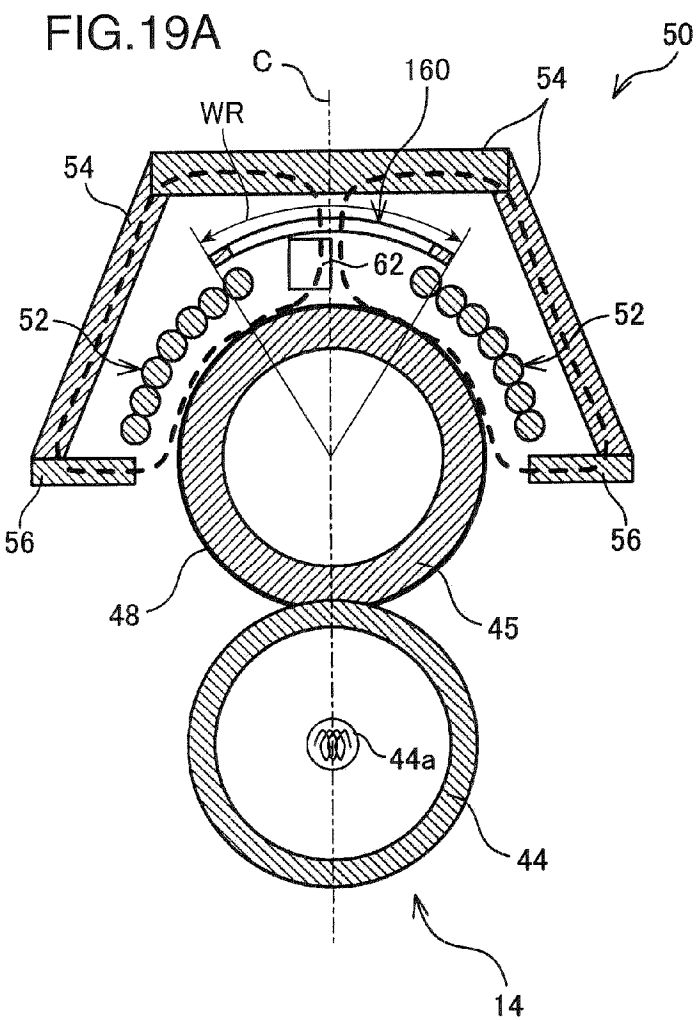

FIGS. 19A and 19B are diagram showing the magnetism adjusting method using the magnetism adjusting member 160, wherein FIG. 19A shows a state where the magnetism adjusting member 160 is displaced to the shielding position (first state) and FIG. 19B shows a state where the magnetism adjusting member 160 is displaced to the retracted position (second position).

[Shielding Position]

As shown in FIG. 19A, normally when power is applied to the induction heating coil 52, magnetic paths passing the side cores 56 and the arch cores 54 and vertically passing an air gap at the position of the coil center C to reach the heating belt 48 are formed around the induction heating coil 52. At this time, if the magnetism adjusting member 160 is placed at intermediate positions of the magnetic paths passing the coil center C by the magnetism adjusting mechanism, the magnetic field is canceled by the principle shown in FIG. 5A, wherefore magnetism can be shielded in the range of the magnetism adjusting member 160. At such a shielding position, the frame center (the line L in FIG. 19B connecting the center line, extending in the center of the imaginary arcuate surface of the magnetism adjusting member 160 in the longitudinal direction, and the center axis of the fixing roller 45) of the magnetism adjusting member 160 is substantially aligned with the coil center (C) (first state), as shown in FIG. 19A.

[Retracted Position]

Further, as shown in FIG. 19B, if the magnetism adjusting member 160 is displaced from the coil center C, for example, to a position overlapping with the winding area of the induction heating coil 52 at one side by the magnetism adjusting mechanism, the shielding of the magnetic paths passing the coil center C is canceled to satisfactorily generate a magnetic field. At this time, the magnetism adjusting member 160 exhibits almost no magnetic field canceling effect by the principle shown in the lower part of FIG. 5B. Accordingly, there is no likelihood of lowering the intensity of the magnetic field generated by the induction heating coil 52 with the magnetism adjusting member 160 displaced to the retracted position. In this way, the heating belt 148 can be induction heated with high efficiency to shorten a warm-up time. At such a retracted position, the frame center (L in FIG. 19B) of the magnetism adjusting member 160 and the coil center C do not overlap (second state).

In this way, the magnetism adjusting mechanism functions as a switcher for switching the magnetism adjusting member 160 to the shielding position, i.e. the first state where the magnetism adjusting member 160 exhibits the magnetic shielding effect and to the retracted position, i.e. the second state where the magnetism adjusting member 160 does not exhibit the magnetic shielding effect.

[Condition Setting]

Next, condition setting for the fixing unit 14 of the second embodiment is described. The magnetism adjusting members 160 are preferably made of a material which is nonmagnetic and good in electrical conductivity in order to suppress the generation of Joule heat by an induction current and to efficiently shield magnetism, and oxygen-free copper or the like material is used as described above. In order to improve electrical conductivity, it is necessary to select a material with as small a specific resistance as possible and to increase the thickness of the material. According to conditions found out by the inventors of the present invention, the thickness of the magnetism adjusting member 160 is preferably selected from a range of 0.5 mm to 3 mm. In this example, the one having a thickness of 1 mm is used.

The following conditions are presented by the inventors of the present invention for an angle by which the magnetism adjusting member 160 is displaced. For example, as shown in FIG. 19B, a horizontal line passing the axial center of the fixing roller 45 as a center (horizontal line in FIG. 19B, different from an actually mounted state) is assumed to represent a reference angle (=0°). If an angle (°) of the frame center L of the magnetism adjusting member 160 is set in a counterclockwise direction from the center, the above shielding position is optimally set at a position of 90°. On the other hand, optimal conditions can be set based on the following idea for an angle α of the retracted position.

Figure 20:
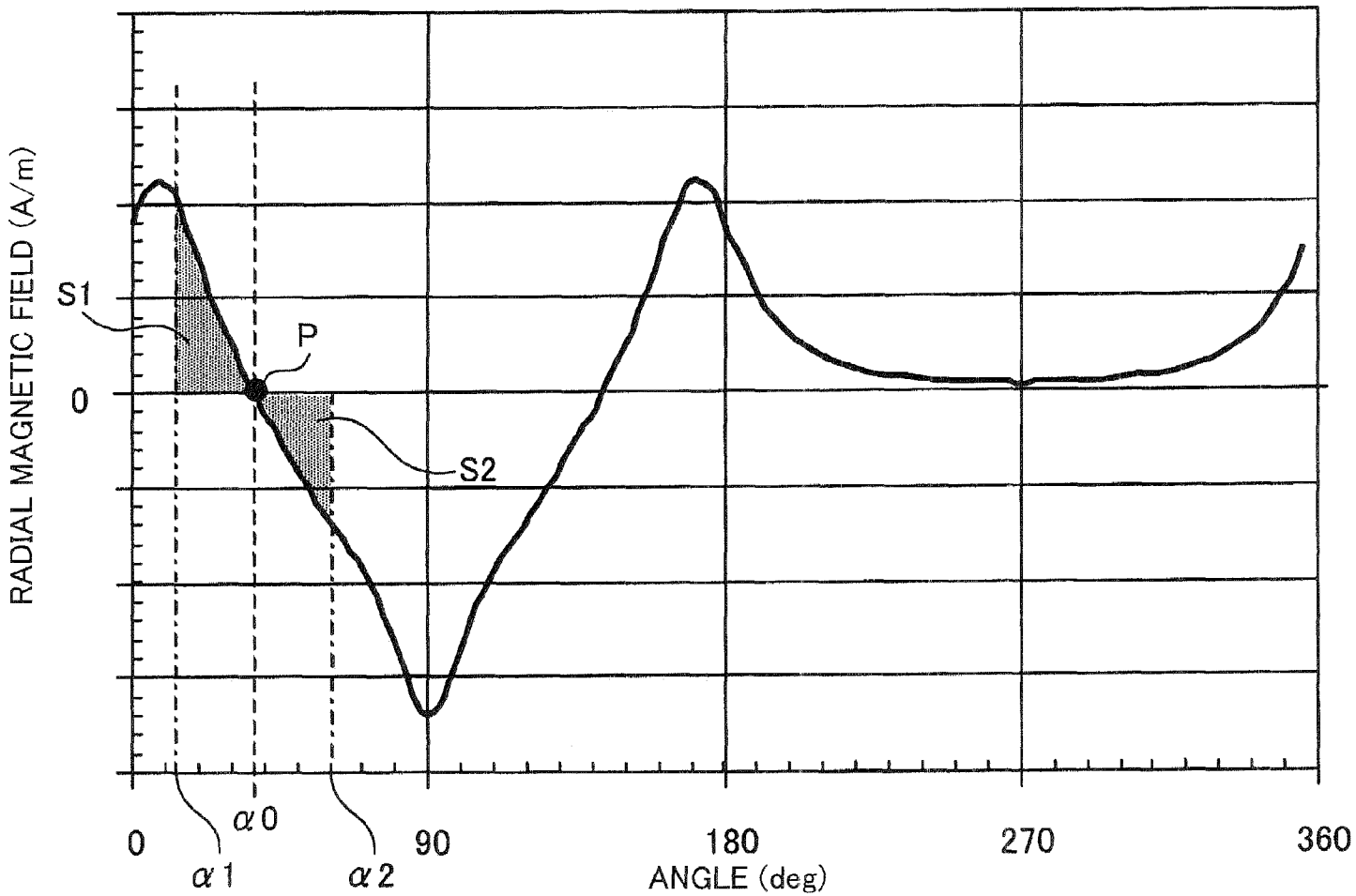
FIG. 20 is a graph showing a distribution curve representing intensity distribution of a radial magnetic field when viewed around a fixing roller (360°).

FIG. 20 is a graph showing a distribution curve representing an intensity distribution of a radial magnetic field around (360°) the fixing roller 45. As shown in FIG. 20, a horizontal axis represents angle (°) in the counterclockwise direction from the above reference angle (=0°) and a vertical axis represents, for example, the radial magnetic field (A/m). Here, if it is assumed that the magnetism adjusting member 160 is displaced to the retracted position and no magnetic field canceling effect is acting, the radial magnetic field has peaks near 0°, 90° and 180° and almost no magnetic field is generated near 270° (right below) where the induction heating coil 52 is not arranged.

In such a magnetic field distribution, a point P where the radial magnetic field becomes 0 on the distribution curve is first taken and angles α1, α2 where integration values of the distribution curve in directions toward 0° and 90° from this point P are equal (areas S1, S2 in FIG. 20 are equal) are calculated. If the magnetism adjusting member 160 is arranged in this calculated angle range of α1 to α2, the magnetic field is balanced out at 0, with the result that the magnetic field is not hindered.

Then, an angle (=(α1+α2)/2) as a midpoint of the angles α1, α2 on the horizontal axis is calculated and set as an angle of the frame center L at the retracted position. If a distance from the center of the fixing roller 45 to the magnetism adjusting member 160 is a radius r, the length of an imaginary arc having this radius r and located in the angle range of α1 to α2 is an optimal frame width of the magnetism adjusting member 160. In this example, the frame width WR can be calculated by the following equation.

$$WR=r\times\{(\alpha 2-\alpha 1)/180\}\times\pi$$

By setting the frame width of the magnetism adjusting member 160 to WR (above equation), setting the angle of the frame center at the retracted position to (α2−α1)/2 and setting the angle of the frame center at the shielding position to 90°, optimal conditions can be set. Particularly, since the magnetic field is balanced out (areas S1=S2) inside the frame at the retracted position, there is no likelihood of hindering the generation of the magnetic field by the induction heating coil 52. In the second embodiment, the frame width WR is preferably selected from a range of 1 mm to 5 mm. The selection of the frame width WR in such a range contributes to making the specific resistance of the magnetism adjusting member 160 sufficiently small.

[Arrangement Examples of the Magnetism Adjusting Members]

Figures 21A, 21B, 21C:
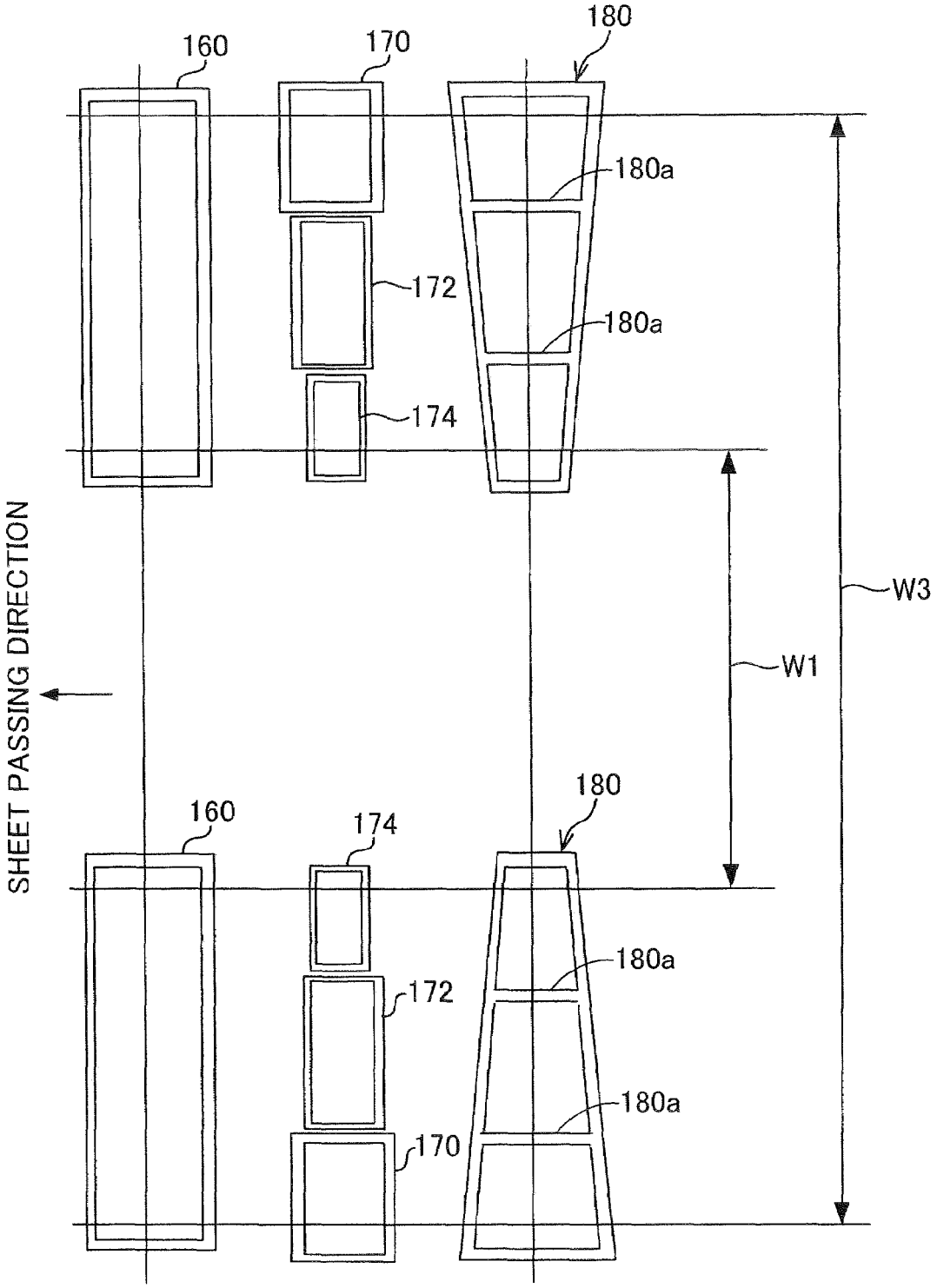
FIGS. 21A to 21C are plan views showing a plurality of arrangement examples of the magnetism adjusting member.

FIGS. 21A to 21C are plan views showing a plurality of arrangement examples of the magnetism adjusting members. It should be noted that the vertical direction in FIGS. 21A to 21C corresponds to the longitudinal direction of the fixing roller 45 (i.e. direction orthogonal to the sheet conveying direction).

In the arrangement example shown in FIG. 21A, each magnetism adjusting member 160 has a single closed frame in rectangular shape and two magnetism adjusting members 160 are arranged in the longitudinal direction. The magnetism adjusting members 160 are arranged at the opposite outer sides of the minimum paper width W1 orthogonal to the sheet conveying direction and only tiny parts thereof are located in the range of the minimum paper width W1. The magnetism adjusting members 160 project slightly outward from the maximum paper width W3 of sheets at the opposite ends of the fixing roller 45. The minimum paper width W1 and the maximum paper width W3 are determined by sheets of the minimum size and the maximum size printable by the image forming apparatus 1.

In the arrangement example shown in FIG. 21B, three magnetism adjusting members 170, 172 and 174 are arranged at each of the opposite sides. Each of the magnetism adjusting members 170, 172 and 174 has a closed frame in rectangular shape, but the frame widths thereof differ in the longitudinal direction. In other words, the frame width of the magnetism adjusting members 174 closest to the minimum paper width W1 is smallest and those of the magnetism adjusting members 172, 172 locate more outward are successively set larger.

In the arrangement example shown in FIG. 21C, two magnetism adjusting members 180 are arranged at the opposite sides and are same as the magnetism adjusting members 160 shown in FIG. 21A in the number, but differ therefrom in that each magnetism adjusting member 180 has a trapezoidal frame shape and two bridge portions 180*a* are provided at two inner positions. In other words, the frame widths of the respective magnetism adjusting members 180 are shortest at positions close to the longitudinal center and gradually increase toward the opposite ends. The bridge portions 180*a* are arranged while being spaced apart in the longitudinal direction, and three frames are formed in one magnetism adjusting member 180 by these bridge portions 180*a*.

[Dealing with Size Switching]

Various sheet sizes can be dealt with by switching the positions of the magnetism adjusting members 160 to 180 to partially shield the magnetic field. At this time, excessive temperature increases can be prevented at the opposite ends of the heating belt 148 by making the positions of the magnetism adjusting members 160 to 180 differ little by little according to the sheet size such that the larger the sheet size, the smaller the magnetic shielding amount and, conversely, the smaller the sheet size, the larger the magnetic shielding amount. Although only the term "magnetism adjusting members 160" is written to prevent complication in the following description, this term also means the magnetism adjusting members 170, 172, 174 and 180 shown in FIGS. 21A to 21C.

Figure 22B:
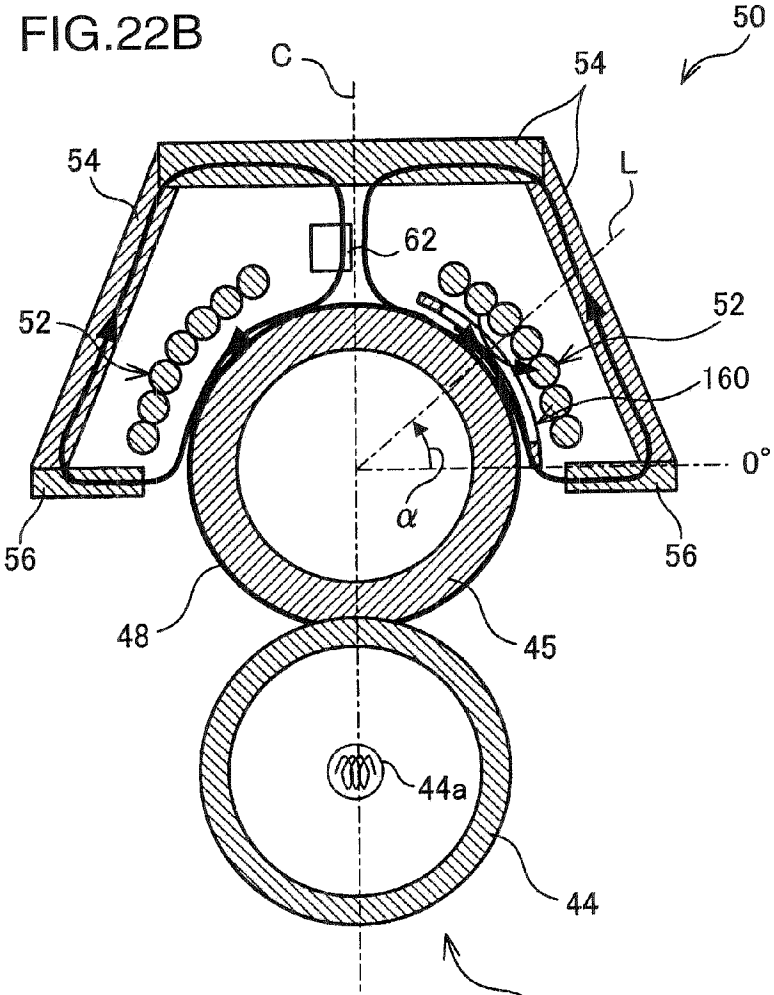
FIGS. 22A and 22B are vertical sections showing modification of the fixing unit according to the second embodiment.
Figure 22A:
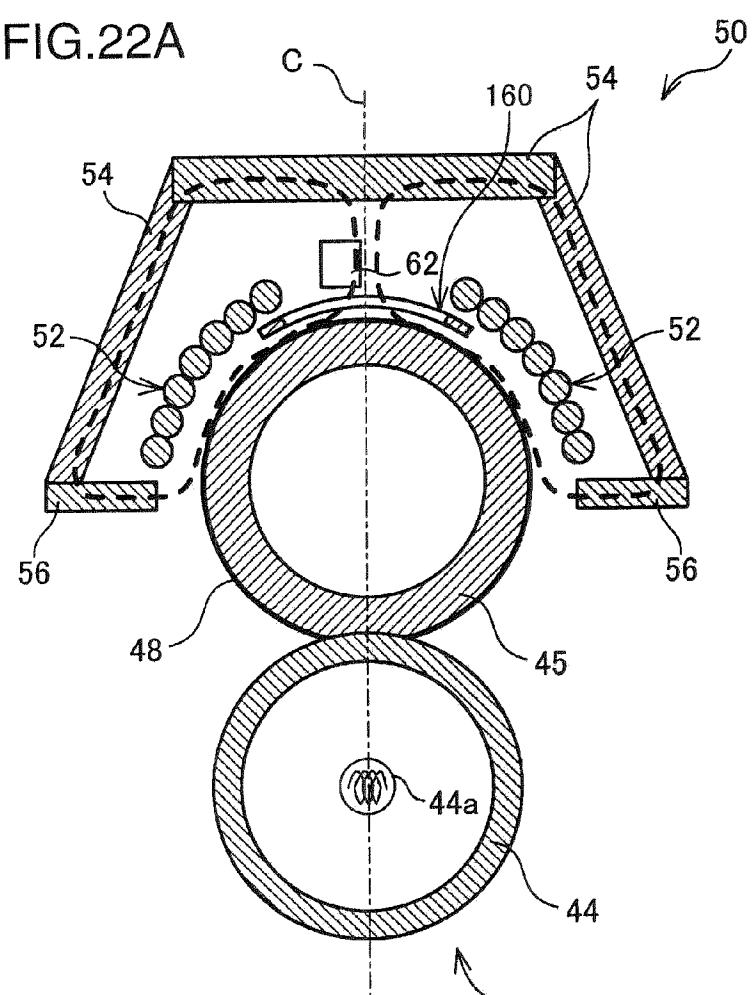

FIGS. 22A and 22B are vertical sections showing a modification of the fixing unit 14 of the second embodiment. A magnetism adjusting method using the magnetism adjusting member 160 is shown in FIGS. 22A and 22B. FIG. 22A shows a state where the magnetism adjusting member 160 is displaced to the shielding position and FIG. 22B shows a state where the magnetism adjusting member 160 is displaced to the retracted position.

This modification differs from the second embodiment in that the magnetism adjusting member 160 is displaced between the induction heating coil 52 and the fixing roller 45 (heating belt 148). The other constructions are common to the second embodiment, and items common to the already described constructions are identified by the same reference numerals and not repeatedly described.

[Shielding Position]

When power is applied to the induction heating coil 52, magnetic paths passing the side cores 56 and the arch cores 54 and vertically passing an air gap at the position of the coil center C to reach the heating belt 148 are formed around the induction heating coil 52. At this time, if the magnetism adjusting members 160 are placed at intermediate positions of the magnetic paths passing the coil center C between the induction heating coil 52 and the fixing roller 45 as shown in FIG. 22A, the magnetic field is canceled by the principle shown in FIG. 5A, wherefore magnetism can be shielded in the ranges of the magnetism adjusting members 160. At the shielding position, the frame centers (center lines of the frame surfaces) of the magnetism adjusting members 160 and the above coil center (C) in the shown cross section substantially overlap.

[Retracted Position]

On the other hand, as shown in FIG. 22B, if the magnetism adjusting members 160 are displaced from the coil center C, for example, to positions overlapping with the winding area of the induction heating coil 52 at one side between the induction heating coil 52 and the fixing roller 45, the shielding of the magnetic paths passing the coil center C is canceled to satisfactorily generate a magnetic field. Since the magnetism adjusting members 160 exhibit almost no magnetic field canceling effect by the principle shown in the lower part of FIG. 5B, there is no likelihood of hindering the intensity of the magnetic field generated by the induction heating coil 52 at the retracted position. At the retracted position, the frame centers (L in FIG. 22B) of the magnetism adjusting members 160 and the coil center C do not overlap.

Those shown in the second embodiment can be applied for the other condition setting. In this modification, the distance (radius r) from the center of the fixing roller 45 to the magnetism adjusting members 160 is shorter than in the second embodiment and, hence, the frame width is smaller by that much.

Figure 23:
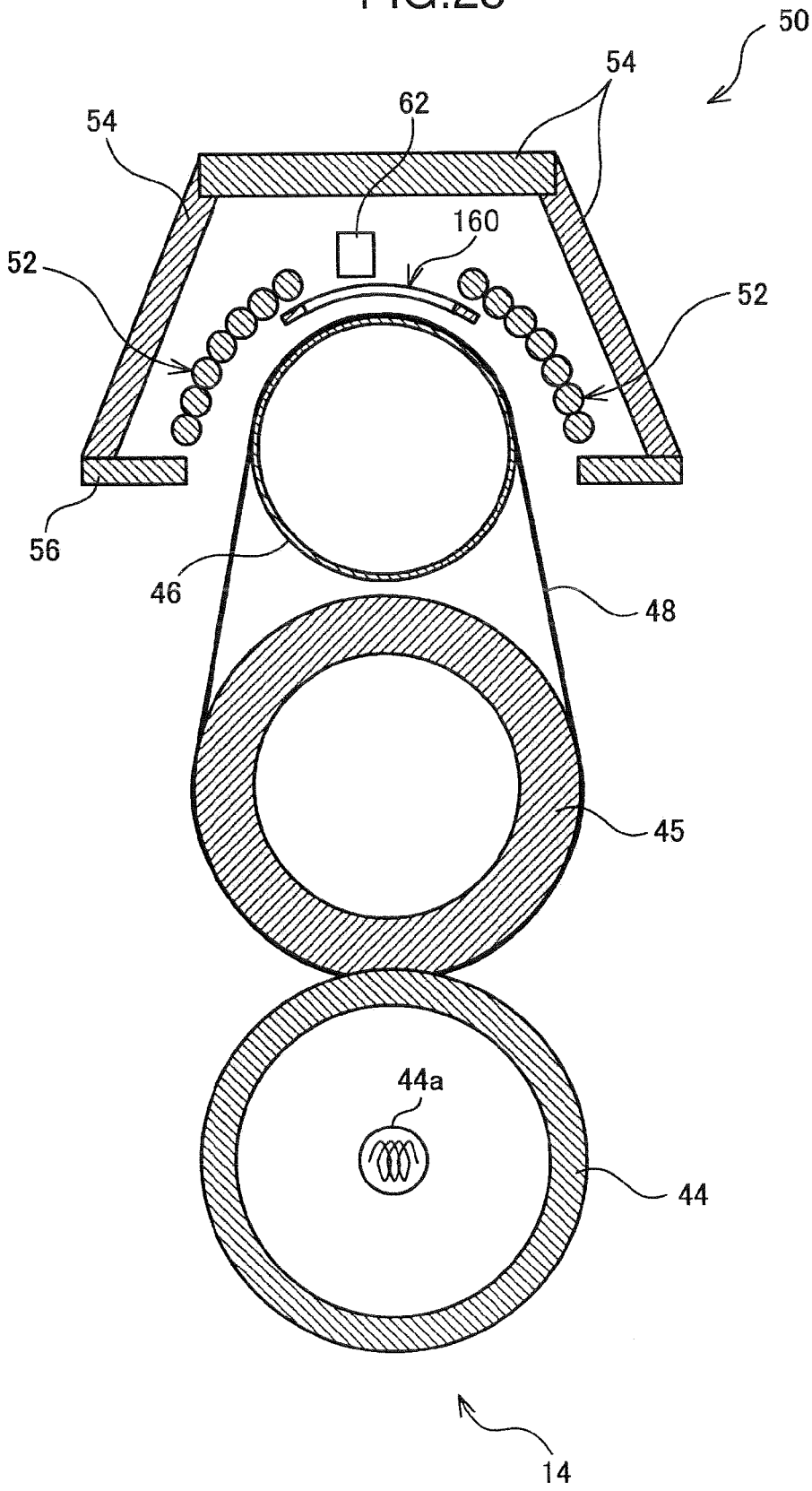
FIG. 23 is a vertical section showing another modification of the fixing unit according to the second embodiment.

FIG. 23 is a vertical section showing another modification of the fixing unit 14 of the second embodiment. This fixing unit 14 is such that the heat roller 46 is disposed in proximity to the fixing roller 45 and the heating belt 48 is mounted on the heat roller 46 and the fixing roller 45. The core of the heat roller 46 is, for example, made of iron and a mold releasing layer (e.g. PFA) is formed on the outer surface of the core.

In this modification, induction heating is performed by arcuate parts of the heating belt 48 and the heat roller 46. In other words, the magnetic field generated by the induction heating coil 52 passes the side cores 56, the arch cores 54 and an air gap at the position of the coil center and passes through the heating belt 48 and the heat roller 46 to induction heat these.

In this modification as well, magnetism can be shielded in the ranges of the magnetism adjusting members 160 by moving the magnetism adjusting members 160 to the shielding position similar to the second embodiment. In this way, excessive temperature increases at the opposite ends of the heating belt 48 and the heat roller 46 can be reliably prevented at the time of switching the size. In the case of a large-size sheet, the magnetic shielding effect can be canceled by moving the magnetism adjusting members 160 to the retracted position to quickly warm up the heating belt 48 and the heat roller 46.

Although FIG. 23 shows the example in which the magnetism adjusting members 160 are arranged between the induction heating coil 52 and the heating belt 48 (heat roller 46), the magnetism adjusting members 160 may be arranged between the induction heating coil 52 and the arch cores 54 and displaced between them as in the second embodiment.

Third Embodiment

Figure 24B:
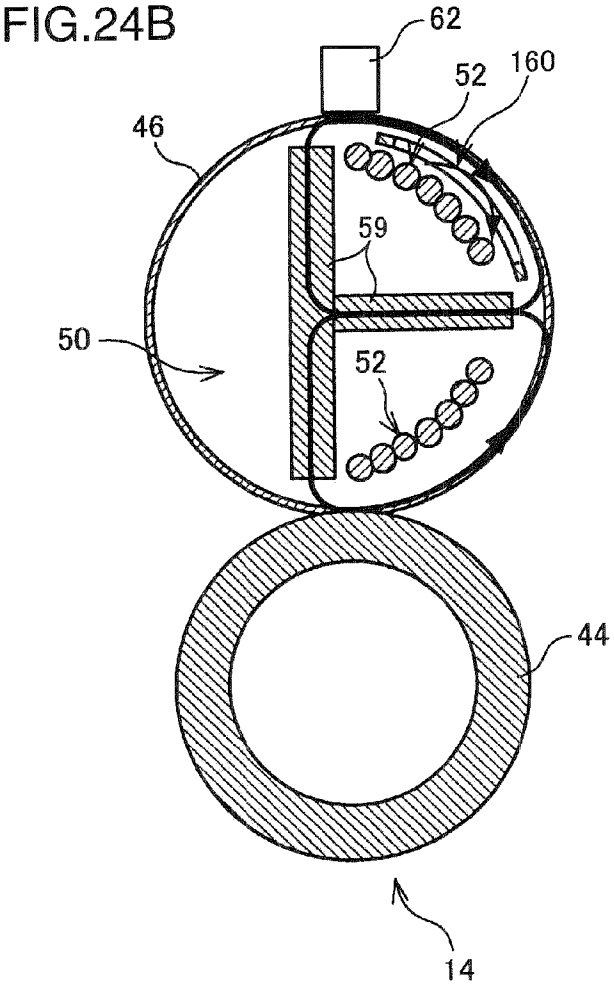
FIGS. 24A and 24B are vertical sections showing a fixing unit according to a third embodiment.
Figure 24A:
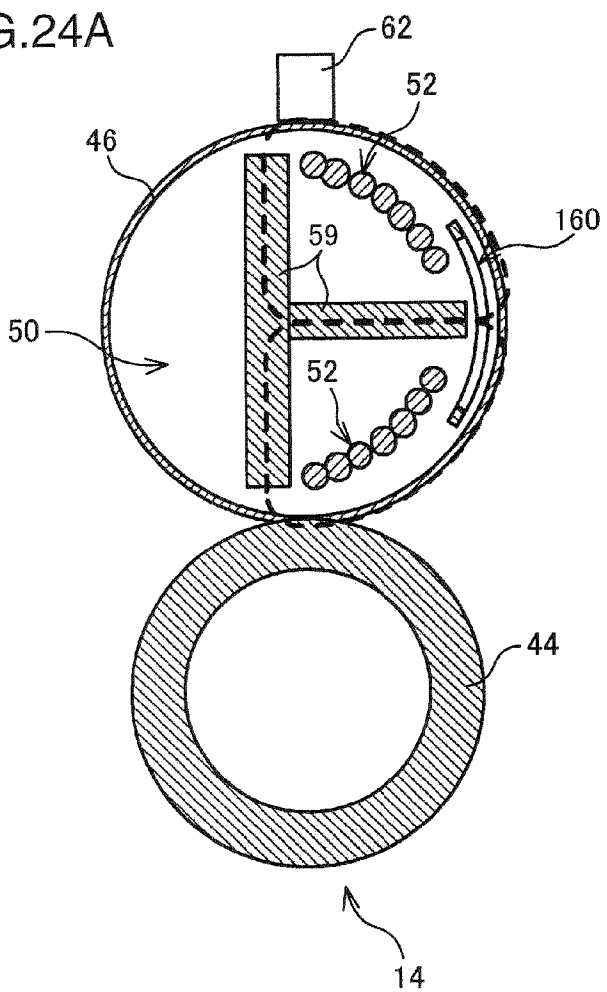

FIGS. 24A and 24B are vertical sections showing a third embodiment of fixing unit 14. The fixing unit 14 of the third embodiment differs from the first and second embodiments in including an internal IH coil unit 50. The construction of magnetism adjusting members 160 may be common to the second embodiment. The magnetism adjusting members 160 are displaceable between a shielding position and a retracted position by the magnetism adjusting mechanism described with reference to FIG. 17.

Specifically, the fixing unit 14 of the third embodiment includes a pressure roller 44 and a heat roller 46 and fixes a toner image while conveying a sheet through a nip between these rollers. Since the heat roller 46 is a metallic roller, this structure is suitably applicable for fixing a black-and-white image. By providing an elastic layer as an outer layer of the heat roller 46, a flat nip NP may be formed between the heat roller 46 and the pressure roller 44. In this case, the structure is suitably applicable for fixing a full color image similar to the first and second embodiments.

The internal IH coil unit 50 includes an induction heating coil 52 and a ferrite core 59 provided inside the heat roller 46. In other words, the induction heating coil 52 is arranged along the inner circumferential surface of the heat roller 46 and the coil center thereof, for example, extends in a horizontal direction from the axial center of the heat roller 46 in FIGS. 24A and 24B.

The ferrite core 59 is formed by combining two pieces in such a manner as to have a T-shaped cross section. One piece extends along the coil center of the induction heating coil 52 and the other piece extends in radial directions at the opposite sides of the coil center.

[Shielding Position]

In the internal IH coil unit 50 as well, when power is applied to the induction heating coil 52, magnetic paths passing from the ferrite core 59 to parts of the heat roller 46 and converged to the ferrite core 59 at the position of the center core are formed around the induction heating coil 52. In such an internal IH coil unit 50 as well, if the magnetism adjusting members 160 are placed at intermediate positions of the magnetic paths passing the coil center as shown in FIG. 24A, the magnetic field is canceled by the principle shown in FIG. 5A, wherefore magnetism can be shielded in the ranges of the magnetism adjusting members 160. At the shielding position, the frame centers (center lines of the frame surfaces) of the magnetism adjusting members 160 and the above coil center (C) in the shown cross section substantially overlap (first state).

[Retracted Position]

On the other hand, as shown in FIG. 24B, if the magnetism adjusting members 160 are displaced from the coil center, for example, to positions overlapping with the winding area of the induction heating coil 52 at one side (upper side in FIG. 24B), the shielding of the magnetic paths passing the coil center is canceled to satisfactorily generate a magnetic field. At this time, since the magnetism adjusting members 160 exhibit almost no magnetic field canceling effect by the principle shown in the lower part of FIG. 5B, there is no likelihood of hindering the intensity of the magnetic field generated by the induction heating coil 52. Thus, the heat roller 46 can be induction heated with high accuracy and the warm-up time can be shortened. In the third embodiment as well, the frame centers of the magnetism adjusting members 160 do not overlap with the coil center (second state) at the retracted position.

In the third embodiment as well, magnetism can be shielded in the ranges of the magnetism adjusting members 160 by moving the magnetism adjusting members 160 to the shielding position similar to the second embodiment. In this way, excessive temperature increases at the opposite ends of the heat roller 46 can be reliably prevented at the time of switching the size. In the case of a large-size sheet, the magnetic shielding effect can be canceled by moving the magnetism adjusting members 160 to the retracted position to quickly warm up the heat roller 46.

Although FIGS. 24A and 24B show the example in which the magnetism adjusting members 160 are arranged between the induction heating coil 52 and the heat roller 46, the ferrite core 55 arranged along the coil center may be shortened and the magnetism adjusting members 160 may be arranged at the inner side of the induction heating coil 52, utilizing a space left by shortening the ferrite core 55.

The fixing units 14 of the second and third embodiments can be variously modified and embodied. The shape and arrangement of the magnetism adjusting members 160 are not limited to those shown in FIGS. 21A to 21C, and other shape and arrangement may be employed.

In the fixing unit 14 of the third embodiment, the IH coil unit 50 may be arranged at a flat part of the heating belt 48 instead of being arranged at the arcuate part of the heating belt 48. In this case, the magnetism adjusting members 160 may have a flat shape as a whole and may be displaced by being slid in straight directions between the induction heating coil 52 and the arch cores 54 or between the induction heating coil 52 and the heating belt 48.

The image forming apparatus, particularly the fixing unit described above mainly embraces the following constructions.

An image forming apparatus according to the present invention includes an image forming unit for transferring a toner image to a sheet, and a fixing unit having a heating member and a pressing member and adapted to convey the sheet while holding the sheet between the heating member and the pressing member and to fix the toner image to the sheet by heat at least from the heating member in a conveying process. The heating member has a first area where a sheet does not come into contact with the heating member when the sheet being conveyed by the fixing unit passes the heating member, and a second area where the sheet comes into contact with the heating member when the sheet being conveyed by the fixing unit passes the heating member, the first area and the second area set according to the size of the sheet. The fixing unit further includes a coil for forming a magnetic field by generating magnetism for induction heating the heating member, a core made of a magnetic material to form a magnetic path near the coil, a magnetism adjusting member made of a nonmagnetic material, arranged on the magnetic path and having a closed frame, and a switcher capable of switching the magnetism adjusting member between a first state where the magnetism adjusting member generates an induction current resulting from the magnetic field to shield the magnetism in the first area, and a second state where the magnetism adjusting member generates no induction current and the magnetism is not shielded in the first area.

According to the image forming apparatus of the present invention, an excessive temperature increase in the first area can be suppressed since the magnetism adjusting member shields the magnetism in the first area upon the switch to the first state by the switcher. Further, since the magnetism adjusting member does not shield the magnetism in the first area upon the switch to the second state by the switcher, the induction heating of the first area can be promoted.

In the image forming apparatus of the above construction, the coil is arranged along an outer surface of the heating member, the core is arranged at a side of the coil opposite to the heating member, the magnetism adjusting member is arranged between the coil and the heating member, the switcher is a magnetic shielding body switchable between a shielding state for shielding the magnetism in the first area and a permitting state for permitting the passage of the magnetism, and the magnetism adjusting member is switched to the first state when the magnetic shielding body is switched to the shielding state while being switched to the second state when the magnetic shielding body is switched to the permitting state.

According to this construction, the switch of the sheet size can be dealt with by shielding the magnetism and permitting the passage of the magnetism in the first area of the heating member by means of the magnetic shielding body. However, if the area of the magnetic shielding body is increased only aiming at the magnetic shielding effect, the influence on the magnetic field conversely increases by hindering the passage of the magnetism in the case of permitting the passage of the magnetism. Therefore, it is difficult to obtain a good magnetic shielding effect only by the magnetic shielding body.

However, in the above construction, an excessive temperature increase suppressing effect is improved without increasing the area of the magnetic shielding body and it is made more unlikely to influence the magnetic field at the time of permitting the passage of the magnetism by arranging the frame-shaped magnetism adjusting member between the coil and the heating member. In other words, the magnetism adjusting member compensates for the magnetic shielding by the magnetic shielding body and prevents magnetic fluxes leaking from the shielding by the magnetic shielding body in the first area from acting on the heating member.

The magnetism adjusting member employing the above construction has the following merits. Specifically, since the magnetism adjusting member is a closed frame, if a magnetic field (interlinkage flux) perpendicular to the plane of the inside of the frame penetrates, an induction current is generated in a circumferential direction of the frame to generate an opposite magnetic field acting in a direction opposite to the penetrating magnetic field. This opposite magnetic field cancels the magnetic field (interlinkage flux) penetrating the inside of the frame in the perpendicular direction, whereby the magnetism adjusting member can compensate for the magnetic shielding. On the other hand, if a magnetic field passes in opposite directions or in a U-turn direction inside the frame, no induction current is generated and no magnetic shielding effect is exhibited.

Focusing on the properties of the magnetism adjusting member as described above, the inventors of the present invention found out an optimal arrangement of the magnetism adjusting member between the coil and the heating member. If the magnetic shielding body is in the shielding state, the magnetism adjusting member in an optimal arrangement can cancel the magnetic field by the induction current generated in the frame since the magnetic field (magnetic flux) leaking from the magnetic shielding body tries to penetrate the inside of the frame. On the other hand, if the magnetic shielding body is in the permitting state, the magnetic field generated around the coil passes in both directions or in a U-turn direction inside the frame. Thus, almost no induction current is generated inside the frame this time and the passage of the magnetism can be permitted. Therefore, the excessive temperature increase suppressing effect can be exhibited more than at present without extremely increasing the area of a member for shielding.

In the above construction, the magnetic shielding body includes a shielding member made of a nonmagnetic metal and switches the shielding member between a shielding position where the shielding member is positioned in the magnetic path, passing the core and the heating member around the coil, to shield the magnetism, and a retracted position where the shielding member is positioned outside the magnetic path to permit the passage of the magnetism.

According to this construction, even without increasing the area of the shielding member very much, the magnetic shielding can be compensated by the magnetism adjusting member with the shielding member switched to the shielding position. On the other hand, with the shielding member switched to the retracted position, the magnetism adjusting member does not influence the magnetic field, wherefore the heating member can be sufficiently induction heated, contributing to the shortening of the warm-up time thereof.

In the above construction, the heating member is a ferromagnetic body and the magnetic shielding body includes, in addition to the shielding member, a movable core interposed between the core and the heating member with respect to a direction in which the magnetic field is generated by the coil and having an outer surface on which the shielding member is arranged.

In the above construction, the heating member is a nonmagnetic body, and the magnetic shielding body includes a movable core provided inside the heating member to form a magnetic path penetrating the heating member and having an outer surface on which the shielding member is arranged. Since the heating member causes the magnetic field to penetrate therethrough, it is sufficient to arrange the shielding member inside.

Further, in the above construction, the magnetic shielding body is formed by the heating member made of a magnetic shunt metal material and shields the magnetism in the magnetic field generated by the coil upon being heated to or above a Curie temperature while induction heating the heating member by permitting the passage of the magnetism in a state where the Curie temperature is not reached yet. In this way, even without particularly switching the shielding member to the shielding position and the retracted position, the heating member itself can shield the magnetism and permit the passage thereof according to temperature (Curie temperature). In this construction as well, by optimally arranging the magnetism adjusting member, it is possible to permit the passage of the magnetism without influencing the magnetic field during heating while assisting the magnetic shielding effect.

In the above construction, the magnetism adjusting member may be in the form of one rectangular frame having a common outer peripheral part and having the inside thereof divided into a plurality of sections in a direction orthogonal to the sheet conveying direction or may include a plurality of rectangular frame-shaped members arranged in a direction orthogonal to the sheet conveying direction.

As described above, since the magnetism adjusting member exhibits the magnetic shielding effect in the range of the inside of the frame, various sheet sizes can be dealt with by dividing the magnetism adjusting member into a plurality of frame parts or arranging a plurality of members.

In the image forming apparatus of the above construction, particularly in the fixing unit of another construction, it is preferable that the coil is arranged along the outer surface of the heating member and formed around a specified coil center to generate the magnetic field, the core is arranged at a side of the coil opposite to the heating member and forms the magnetic path passing the coil center around the coil, the magnetism adjusting member has a specified frame center, and the switcher switches the magnetism adjusting member between a first state where the frame center is substantially aligned with the coil center at an intermediate position of the magnetic path, passing the coil center and reaching the heating member, to shield the magnetism, and a second state where the magnetism adjusting member is displaced from the magnetic path with the frame center offset from the coil center to permit the passage of the magnetism.

In this construction as well, by the above properties of the magnetism adjusting member, a sufficient magnetic shielding effect can be obtained in the first area when the magnetism adjusting member is in the first state. Further, when the magnetism adjusting member is in the second state, the magnetic shielding effect in the first area can be suppressed. In this way, it is possible to obtain a sufficient temperature increase and to shorten the warm-up time without reducing heating efficiency during the induction heating of the heating member. Further, since the magnetism adjusting member may overlap with the winding area of the coil in the second state, it is not necessary to ensure a storage space up to the outside of the coil or core and, accordingly, space saving can be promoted. Since the magnetism adjusting member is frame shaped and hollow, the mass of the member can be suppressed even if a sufficiently wide range (frame width) is ensured. Thus, it is possible to reduce material cost and to suppress power (e.g. motor output) upon displacing the magnetism adjusting member to a minimum level.

The fixing unit of the above construction is structured such that the coil and the core are arranged outside the heating member (so-called external IH), it may be structured such that the coil and the core are arranged inside the heating member (so-called internal IH). In this case, in the fixing unit, it is preferable that the coil is arranged along a heating area on an inner surface of the heating member in a circumferential direction of the heating member and formed around a specified coil center to generate the magnetic field for induction heating the heating member in the heating area, the core is arranged inside the heating member together with the coil and forms the magnetic path passing the coil center of the coil, the magnetism adjusting member has a specified frame center, and the switcher switches the magnetism adjusting member between a first state where the frame center is substantially aligned with the coil center at an intermediate position of the magnetic path, passing the coil center and reaching the heating member, to shield the magnetism, and a second state where the magnetism adjusting member is displaced from the magnetic path with the frame center offset from the coil center to permit the passage of the magnetism.

Similarly in the above construction (internal IH), a sufficient magnetic shielding effect by the magnetism adjusting member can be obtained by displacing the magnetism adjusting member to the shielding position inside the heating member. In the second state, sufficient heating efficiency can be exhibited since the magnetism adjusting member satisfactorily permits the passage of the magnetism. In this case, sufficient space saving can be promoted since the coil and the core including the magnetism adjusting member can be arranged inside the heating member.

In the above construction of the external IH, it is preferable that the switcher is capable of displacing the magnetism adjusting member between the coil and the core. In the above construction of the internal IH, the switcher is capable of displacing the magnetism adjusting member between the heating member and the coil. In either construction, the magnetism adjusting member can shield the magnetism at the intermediate position of the magnetic path passing the coil center in the first state or can reliably permit the passage of the magnetism in the second state.

In the above external and internal IH constructions, the second state to which the switcher switches the state of the magnetism adjusting member is a state where a current flowing in a circumferential direction of the magnetism adjusting member is substantially zero upon the generation of the magnetic field by the coil. In other words, if the current flowing in the magnetism adjusting member (in the frame) is zero in the second state, a magnetic field opposite to the magnetic field generated by the coil is not generated therefrom, wherefore the magnetic induction of the heating member is not hindered.

In the above external and internal IH constructions, it is preferable that the switcher is capable of reciprocating the magnetism adjusting member between the first state and the second state to adjust a magnetic shielding amount according to a displacement amount of the magnetism adjusting member between these states. According to this construction, when the switcher displaces the magnetism adjusting member, the magnetism is hardly (not at all) shielded in the second state, but the magnetic shielding amount can be gradually increased as the state is switched from the second state to the first state. Therefore, as the temperature of the heating member increases, the magnetic shielding amount can be finely adjusted.

Further, in the above external and internal IH constructions, it is preferable that the magnetism adjusting member is divided, in a direction orthogonal to the sheet conveying direction, into a plurality of rectangular frame members and the frame members have different frame widths in the sheet conveying direction and the frame width is set to be minimum near a minimum sheet area where the sheet of minimum size out of the sheets conveyed by the fixing unit passes.

The frame-shaped magnetism adjusting members exhibit the magnetic shielding effect in the ranges of the insides of the frames. Thus, out of the plurality of magnetism adjusting members, the one having the largest frame width has a largest magnetic shielding amount and the one having the smaller frame width has a smaller magnetic shielding amount. Accordingly, if the frame width is minimized near the minimum paper area where an excessive temperature increase of the heating member is normally unlikely to become problematic and the frame width is increased in a sheet width direction (width direction of the heating member) away from the minimum paper area, the magnetism can be effectively shielded at the outer sides of the minimum paper area where an excessive temperature increase particularly becomes problematic. Therefore, the magnetic shielding can be reliably switched in accordance with the sheet size.

In the above construction, it is preferable that the magnetism adjusting member is made of a nonmagnetic metal conductor made of copper, and the width thereof is set to 1 mm to 5 mm and the thickness thereof is set to 0.5 mm to 3 mm. Since the magnetism adjusting member efficiently shields the magnetism by suppressing the generation of Joule heat of its own, it is necessary to maximally reduce the specific resistance (electrical resistance) of the member. If the material is selected and the dimension is set as above, the specific resistance of the magnetism adjusting member can be made sufficiently small. As a result, it is possible to ensure good electrical conductivity, to obtain a sufficient magnetic shielding effect and to make the magnetism adjusting member lighter.

In the present invention, it is preferable that the heating member is one of a metallic roller and a metallic belt wound around the metallic roller. In either case, it is suitable for an induction heating method by the coil.

This application is based on Japanese Patent Application Nos. 2008-000433 and 2008-000686 filed on Jan. 7, 2008 respectively, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an image forming unit for transferring a toner image to a sheet; and a fixing unit including a heating member and a pressing member and adapted to convey the sheet while holding the sheet between the heating member and the pressing member and to fix the toner image to the sheet by heat at least from the heating member in a conveying process, wherein:

the heating member has a first area where a sheet does not come into contact with the heating member when the sheet being conveyed by the fixing unit passes the heating member, and a second area where the sheet comes into contact with the heating member when the sheet being conveyed by the fixing unit passes the heating member, the first area and the second area set according to the size of the sheet, and the fixing unit further includes:

a coil for forming a magnetic field by generating magnetism for induction heating the heating member, a core made of a magnetic material to form a magnetic path near the coil, a magnetism adjusting member made of a nonmagnetic material, arranged on the magnetic path and having a closed frame having a hollow at an inside thereof, and a switcher capable of switching the magnetism adjusting member between a first state where the magnetism adjusting member generates an induction current resulting from the magnetic field to shield, inside the hollow, the magnetism in the first area, and a second state where the magnetism adjusting member generates no induction current and the magnetism is not shielded in the first area.

2. An image forming apparatus according to claim 1, wherein:

the coil is arranged along an outer surface of the heating member;

the core is arranged at a side of the coil opposite to the heating member;

the magnetism adjusting member is arranged between the coil and the heating member;

the switcher is a magnetic shielding body switchable between a shielding state for shielding the magnetism in the first area and a permitting state for permitting the passage of the magnetism; and the magnetism adjusting member is switched to the first state when the magnetic shielding body is switched to the shielding state while being switched to the second state when the magnetic shielding body is switched to the permitting state.

3. An image forming apparatus according to claim 2, wherein the magnetic shielding body includes a shielding member made of a nonmagnetic metal and switches the shielding member between a shielding position where the shielding member is positioned in the magnetic path, passing the core and the heating member around the coil, to shield the magnetism, and a retracted position where the shielding member is positioned outside the magnetic path to permit the passage of the magnetism.

4. An image forming apparatus according to claim 3, wherein:

the heating member is a ferromagnetic body; and the magnetic shielding body includes, in addition to the shielding member, a movable core interposed between the core and the heating member with respect to a direction in which the magnetic field is generated by the coil and having an outer surface on which the shielding member is arranged.

5. An image forming apparatus according to claim 3, wherein:

the heating member is a nonmagnetic body, the magnetic shielding body includes a movable core provided inside the heating member to form a magnetic path penetrating the heating member and having an outer surface on which the shielding member is arranged.

6. An image forming apparatus according to claim 2, wherein the magnetic shielding body is formed by the heating member made of a magnetic shunt metal material and shields the magnetism in the magnetic field generated by the coil upon being heated to or above a Curie temperature while induction heating the heating member by permitting the passage of the magnetism in a state where the Curie temperature is not reached yet.

7. An image forming apparatus according to claim 1, wherein the magnetism adjusting member is in the form of a single rectangular closed frame having a common outer peripheral part and having the inside thereof divided into a plurality of sections in a direction orthogonal to the sheet conveying direction.

8. An image forming apparatus according to claim 1, wherein the magnetism adjusting member includes a plurality of rectangular closed frame members arranged in a direction orthogonal to the sheet conveying direction.

9. An image forming apparatus according to claim 1, wherein:

the coil is arranged along the outer surface of the heating member and formed around a specified coil center to generate the magnetic field;

the core is arranged at a side of the coil opposite to the heating member and forms the magnetic path passing the coil center around the coil;

the magnetism adjusting member has a specified frame center; and the switcher switches the magnetism adjusting member between a first state where the frame center is substantially aligned with the coil center at an intermediate position of the magnetic path, passing the coil center and reaching the heating member, to shield the magnetism, and a second state where the magnetism adjusting member is displaced from the magnetic path with the frame center offset from the coil center to permit the passage of the magnetism.

10. An image forming apparatus according to claim 1, wherein:

the coil is arranged along a heating area on an inner surface of the heating member in a circumferential direction of the heating member and formed around a specified coil center to generate the magnetic field for induction heating the heating member in the heating area;

the core is arranged inside the heating member together with the coil and forms the magnetic path passing the coil center of the coil;

the magnetism adjusting member has a specified frame center; and the switcher switches the magnetism adjusting member between a first state where the frame center is substantially aligned with the coil center at an intermediate position of the magnetic path, passing the coil center and reaching the heating member, to shield the magnetism, and a second state where the magnetism adjusting member is displaced from the magnetic path with the frame center offset from the coil center to permit the passage of the magnetism.

11. An image forming apparatus according to claim 9, wherein the switcher is capable of displacing the magnetism adjusting member between the coil and the core.

12. An image forming apparatus according to claim 10, wherein the switcher is capable of displacing the magnetism adjusting member between the heating member and the coil.

13. An image forming apparatus according to claim 9, wherein the second state to which the switcher switches the state of the magnetism adjusting member is a state where a current flowing in a circumferential direction of the magnetism adjusting member is substantially zero upon the generation of the magnetic field by the coil.

14. An image forming apparatus according to claim 10, wherein the second state to which the switcher switches the state of the magnetism adjusting member is a state where a current flowing in a circumferential direction of the magnetism adjusting member is substantially zero upon the generation of the magnetic field by the coil.

15. An image forming apparatus according to claim 9, wherein the switcher is capable of reciprocating the magnetism adjusting member between the first state and the second state to adjust a magnetic shielding amount according to a displacement amount of the magnetism adjusting member between these states.

16. An image forming apparatus according to claim 10, wherein the switcher is capable of reciprocating the magnetism adjusting member between the first state and the second state to adjust a magnetic shielding amount according to a displacement amount of the magnetism adjusting member between these states.

17. An image forming apparatus according to claim 9, wherein:

the magnetism adjusting member is divided, in a direction orthogonal to the sheet conveying direction, into a plurality of rectangular closed frame members and the frame members have different frame widths in the sheet conveying direction; and the frame width is set to be minimum near a minimum sheet area where the sheet of minimum size out of the sheets conveyed by the fixing unit passes.

18. An image forming apparatus according to claim 10, wherein:

the magnetism adjusting member is divided, in a direction orthogonal to the sheet conveying direction, into a plurality of rectangular closed frame members and the frame members have different frame widths in the sheet conveying direction; and the frame width is set to be minimum near a minimum sheet area where the sheet of minimum size out of the sheets conveyed by the fixing unit passes.

19. An image forming apparatus according to claim 1, wherein:

the magnetism adjusting member is made of a nonmagnetic metal conductor made of copper; and the width thereof is set to 1 mm to 5 mm and the thickness thereof is set to 0.5 mm to 3 mm.

20. An image forming apparatus according to claim 1, wherein the heating member is one of a metallic roller and a metallic belt wound around the metallic roller.

* * * * *